US010882197B1

(12) United States Patent
Onion

(10) Patent No.: US 10,882,197 B1
(45) Date of Patent: Jan. 5, 2021

(54) EASILY DISASSEMBLED FOLDING KNIFE

(71) Applicant: GB II Corporation, Tualatin, OR (US)

(72) Inventor: Kenneth J. Onion, Kaneohe, HI (US)

(73) Assignee: GB II Corporation, Tualatin, OR (US)

( * ) Notice: Subject to any disclaimer, the term of this patent is extended or adjusted under 35 U.S.C. 154(b) by 0 days.

(21) Appl. No.: 16/380,641

(22) Filed: Apr. 10, 2019

Related U.S. Application Data

(60) Provisional application No. 62/656,556, filed on Apr. 12, 2018.

(51) Int. Cl.
*B26B 5/00* (2006.01)
*B26B 1/04* (2006.01)
*B26B 11/00* (2006.01)

(52) U.S. Cl.
CPC ..... *B26B 5/00* (2013.01); *B26B 1/04* (2013.01); *B26B 11/00* (2013.01)

(58) Field of Classification Search
CPC .. B26B 1/02; B26B 1/04; B26B 11/00; B26B 5/00
See application file for complete search history.

(56) References Cited

U.S. PATENT DOCUMENTS 298,115 A 5/1884 Peace
1,049,931 A 1/1913 Smith
1,182,043 A 5/1916 Schless
1,299,173 A 4/1919 Grey
1,350,251 A 8/1920 Armour
1,353,490 A * 9/1920 Pantalek ..... B26B 1/04 30/160
1,428,296 A 9/1922 Neft
1,487,655 A 3/1924 Hlavacek
1,667,462 A 4/1928 Logan
3,007,244 A * 11/1961 Vern ..... B26B 5/006 30/162
3,061,927 A 11/1962 Von Frankenberg Und Ludwigsdorf
3,488,843 A * 1/1970 Tims ..... B26B 5/00 30/162
3,829,967 A 8/1974 Gilbert
4,161,818 A 7/1979 Phelps
4,218,819 A 8/1980 Phelps
(Continued)

FOREIGN PATENT DOCUMENTS

CN 2194827 Y 4/1995
CN 2275020 Y 2/1998
(Continued)

*Primary Examiner* — Sean M Michalski
(74) *Attorney, Agent, or Firm* — Klarquist Sparkman, LLP

(57) ABSTRACT

Disclosed herein are embodiments of easily disassembled folding knives. In some embodiments, a folding knife includes a blade, a handle including first and second side portions, and a pivot mechanism including respective locking elements which can be used to retain the side portions from lateral separation from one another. In some cases, the locking elements of one end of the pivot mechanism include relatively narrow neck portions with relatively wide, non-circular head portions connected to the neck portions, and the locking elements of a second side of the pivot mechanism include a recess and a corresponding non-circular opening. In some cases, folding knives can be provided with secondary locking mechanisms, liner lock mechanisms, and various other features.

20 Claims, 19 Drawing Sheets

(56) References Cited

U.S. PATENT DOCUMENTS 4,233,737 A * 11/1980 Poehlmann ..... B26B 1/042 30/161
4,408,394 A 10/1983 Phelps
4,730,393 A 3/1988 Coburn
5,022,156 A * 6/1991 Kallens ..... B26B 5/00 30/125
5,572,793 A 11/1996 Collins et al.
5,594,966 A 1/1997 Goldman
5,605,495 A 2/1997 Jenkins, Jr.
5,661,908 A 9/1997 Chen
5,916,277 A 6/1999 Dallas
6,101,723 A 8/2000 Ford
6,134,788 A 10/2000 Chen et al.
6,591,504 B2 7/2003 Onion
6,751,820 B1 6/2004 Wu
6,802,126 B2 10/2004 Huang
6,865,816 B1 * 3/2005 Zajdel ..... B26B 5/00 30/162
6,942,255 B2 9/2005 Pickering
7,022,915 B1 4/2006 Galguera
7,100,285 B1 9/2006 Huang
7,134,207 B2 * 11/2006 Ping ..... B26B 1/042 30/125
7,162,803 B2 1/2007 Lu
7,246,441 B1 7/2007 Collins
7,370,421 B2 5/2008 Onion et al.
7,716,839 B2 5/2010 Onion et al.
8,051,518 B2 11/2011 Massaro
8,087,173 B2 * 1/2012 Tang ..... B25F 1/04 30/157
8,499,460 B1 * 8/2013 Pearman ..... B26B 1/044 30/155
8,893,389 B2 11/2014 Freeman
9,061,426 B2 * 6/2015 Harvey ..... B26B 11/006
9,492,916 B2 * 11/2016 Snyder ..... B26B 1/046
9,586,328 B2 3/2017 Onion
9,592,612 B2 * 3/2017 Koenig ..... B26B 1/06
9,597,809 B2 3/2017 Onion
9,943,970 B2 * 4/2018 Glesser ..... B26B 1/048
10,226,871 B2 * 3/2019 Huang ..... B26B 1/10
10,654,180 B2 * 5/2020 Onion ..... B26B 1/046
2004/0139613 A1 * 7/2004 Onion ..... B26B 5/00 30/161
2005/0257377 A1 11/2005 Lu et al.
2006/0272157 A1 12/2006 Zeng
2007/0011884 A1 1/2007 Hua et al.
2008/0172884 A1 * 7/2008 Cheng ..... B26B 1/02 30/155
2008/0222896 A1 9/2008 Marfione et al.
2010/0177508 A1 7/2010 Maglica
2010/0281696 A1 11/2010 Hao et al.
2011/0041344 A1 2/2011 De et al.
2011/0272265 A1 11/2011 Mortun
2012/0011728 A1 1/2012 Keers
2012/0017443 A1 1/2012 Hao
2012/0124754 A1 5/2012 Frazer
2012/0272534 A1 * 11/2012 Lee ..... B26B 1/10 30/298.4
2013/0174351 A1 * 7/2013 Carson ..... B26B 11/00 7/118
2014/0027234 A1 1/2014 Zhou et al.
2014/0245615 A1 * 9/2014 Onion ..... B26B 1/04 30/155
2016/0029733 A1 * 2/2016 Kovarik ..... A63B 71/10 2/411
2016/0031096 A1 * 2/2016 Koenig ..... B26B 1/02 30/161
2016/0059429 A1 3/2016 Mayes
2016/0271809 A1 * 9/2016 Bloch ..... B26B 5/00
2016/0311123 A1 10/2016 Schoon
2017/0334077 A1 11/2017 Onion et al.
2018/0169874 A1 * 6/2018 Halucha ..... B26B 1/042
2018/0290282 A1 10/2018 Wang
2019/0202073 A1 7/2019 Huang
2019/0321991 A1 * 10/2019 Medhurst ..... B26B 5/00
2020/0101633 A1 * 4/2020 Halucha ..... A45D 24/06

FOREIGN PATENT DOCUMENTS

CN 2326401 Y 6/1999
CN 2385854 Y 7/2000
CN 2456890 Y 10/2001
CN 1303762 A 4/2004
CN 2774721 Y 4/2006
CN 2902614 Y 5/2007
CN 201401419 Y 2/2010
CN 201471444 U 5/2010
CN 201500984 U 6/2010
CN 201544254 U 8/2010
CN 104260025 A 1/2015
GB 108823 A 8/1917
WO WO1999/000224 A2 1/1999

* cited by examiner

EASILY DISASSEMBLED FOLDING KNIFE

CROSS-REFERENCE TO RELATED APPLICATIONS

This application claims the benefit of U.S. Provisional Patent Application No. 62/656,556, filed Apr. 12, 2018, which application is incorporated by reference herein.

FIELD

The present disclosure relates generally to tools configured to be easily disassembled.

BACKGROUND

Folding knives are available in various configurations. In some of these configurations, the blade of a folding knife can be removed without the use of tools to facilitate cleaning, sharpening, replacement, or storing of a blade. As examples, U.S. Pat. Nos. 7,370,421 and 7,716,839 describe a knife having a removable blade. Such knives are sometimes referred to as "field strip" knives because they can be disassembled in the field without the use of tools, such as a screwdriver. Because folding knives having removable blades are particularly advantageous in harsh conditions (i.e., in situations where a knife is likely to become dirty or dull, and thus where the ability to clean, sharpen, or replace a blade in the field is important), it would be beneficial to provide a folding knife with a removable blade having as simple a structure as possible. Simpler configurations can help to ensure that the blade remains easily removable after use in harsh conditions and that removal of the blade can be accomplished as quickly and reliably as possible. Accordingly, simple mechanisms allowing a folding knife to be easily disassembled are desirable.

SUMMARY

The present disclosure is directed toward new and non-obvious methods and apparatuses relating to folding knives and other easily disassembled tools. In one embodiment, a folding knife comprises a handle portion including first and second, laterally spaced side portions defining a blade-receiving cavity therebetween, a pivot mechanism comprising a pivot member, a locking mechanism, and a spring, and a blade pivotably coupled to the pivot mechanism and pivotable relative to the handle about the pivot mechanism between a closed position and an open position.

The first side portion can comprise a first opening at a distal end, the second side portion can comprise a second opening at a distal end, and the blade can comprise a pivot opening through a tang portion of the blade. The pivot member can be disposed within the second opening such that the pivot member extends from an inner surface of the second side portion, and the locking mechanism of the pivot mechanism can be disposed within the first opening. The pivot member can have a non-circular head portion and a neck portion that is narrower than the head portion. The head portion of the pivot member can be sized to fit within an interior recess of the locking mechanism having a non-circular aperture.

The locking mechanism can comprise a cap and a collar. The cap can have an interior recess having an aperture and an interior lip. The cap can be configured to be rotatable between a locked position and an unlocked position relative to the pivot member about an axis extending through the locking mechanism. When the cap is in the locked position, the head portion of the pivot member can be rotationally offset from the aperture of the cap and can engage the interior lip, blocking lateral movement of the first and second side portions relative to one another. When the cap is in the unlocked position, the head portion of the engagement opening can be rotationally aligned with the aperture of the cap to allow the head portion to be moved through the aperture, thus permitting lateral movement of the second side portion away from the first side portion.

In some embodiments, the cap can include an actuator (e.g., a lever) configured to allow a user to rotate the cap between the locked and unlocked positions. In some embodiments, the lever can be pivotable between a vertical position, wherein a user can rotate the lever in order to rotate the cap, and a horizontal position, wherein the lever is disposed substantially parallel to an outer surface of the folding knife, such that the lever is prevented from accidentally rotating the cap. In some embodiments, the cap can comprise a ramped outer lip disposed circumferentially around the outer surface of the cap and configured to engage with a ramped shoulder of the collar. The engagement of the ramped lip and shoulder allows adds an axial component to the rotational motion of the cap.

In some embodiments, the folding knife can also include a secondary securing mechanism at a proximal portion of the handle which can help ensure that the first and second side portions to not inadvertently rotate with respect to each other and thereby become unfastened. The secondary securing mechanism can be first and second recesses and a post, the recesses extending at least partially through the first and second side portions. The post can be configured to extend into the first and second recesses and be coupled to the first and second side portions when the knife is in the assembled configuration. During disassembly the first and second side portions can rotate relative to one another about the post.

In some embodiments, in lieu of a lever, the folding knife can comprise a pivot mechanism having a locking mechanism wherein the cap comprises a textured surface. In such embodiments, a user can disassemble the folding knife by rotating the handle portion of the knife in an unlocking direction (e.g., counter clockwise) while holding the surface stationary in order to prevent the cap from rotating relative to the pivot member. Pivoting the handle portion causes the head portion of the pivot member to pivot within the interior recess of the cap such that the head portion moves between a rotationally aligned and a rotationally offset position with respect to the aperture of the locking mechanism.

In other embodiments, the folding knife can comprise a pivot mechanism having a locking mechanism wherein the cap functions as a button moveable between a raised position and a depressed position and configured to allow a user to rotate the cap between the locked and unlocked position by depressing and rotating the button. The cap can comprise an interior recess having an aperture and an interior lip. The interior lip can be ramped and can engage a head portion of the pivot member when the cap is in the locked position. When the knife is in the assembled configuration, the cap can be biased into a raised position, preventing accidental rotation of the cap relative to the head portion by engagement of the head portion with the ramped interior lip.

In other embodiments, a folding knife comprises a handle portion comprising first and second side portions pivotably connected to a connector, and a blade comprising a pivot member and bearing system extending from a first surface of the blade. When the folding knife is assembled, the handle can couple the pivot member and the bearing system, pivotably coupling the blade and the handle together such that the blade is pivotable relative to the handle between an open and a closed position. The folding knife can further comprise a locking mechanism actuatable between a locked and an unlocked configuration, wherein when in the locked position the locking mechanism is configured to restrain the first and second side portions from moving laterally relative to one another.

In some embodiments, the locking mechanism can be a T-slot locking mechanism having a pivot arm comprising a head portion and a neck portion, and corresponding slots extending laterally through and/or partially through proximal end portions of the first and second side portions. The pivot arm can be pivotably coupled to, for example, the second side portion and be pivotable between locked and unlocked positions. When in the locked position, the neck portion of the pivot arm can be disposed within the corresponding slots and the head portion of the pivot arm can engage an outer surface of the first side portion, thereby restraining the first and second side portions from moving laterally away from one another.

In other embodiments, the locking mechanism can be a hemostat locking mechanism comprising first and second interlocking sets of teeth and actuatable between a locked position and an unlocked position. The first set of teeth can extend from, for example, the first side portion and the second set of teeth can extend from, for example, the second side portion. When in the locked position, the first and second sets of teeth can interlock, thereby restraining the first and second side portions from moving laterally away from one another. To unlock the hemostat mechanism, a user must disengage the first and second sets of teeth using vertical force prior to moving the first and second side portions laterally away from one another.

In some embodiments, a folding knife comprises a handle portion comprising first and second, laterally spaced side portions defining a blade-receiving cavity therebetween, a pivot mechanism coupled to the first side portion, a blade pivotably connected to the pivot mechanism of the handle portion and pivotable relative to the handle portion about the pivot mechanism between a closed position and an open position, and a locking mechanism actuatable between a locked position, wherein the first and second side portions are restrained from moving laterally away from one another, and an unlocked position, wherein the folding knife may be easily disassembled.

In some embodiments, a locking mechanism can comprise a first protrusion coupled to a proximal portion of the first side portion, a second protrusion coupled to a proximal portion of the second side portion, and a retaining member comprising a groove, the groove sized such that the first and second protrusions can be disposed within the groove. The retaining member can be actuatable (e.g., by sliding or pivoting) between a locked position and an unlocked position, wherein when the retaining member is in the locked position the first and second protrusions are disposed within the groove, thereby restricting relative movement of the first and second side portions, and wherein when the retaining member is in the unlocked position the first and second protrusions are spaced apart from the retaining member, thereby allowing relative movement of the first and second side portions.

In some embodiments, a locking mechanism can comprise a post extending from an inner surface of the first side portion and an engagement member comprising an opening. The engagement member can be pivotably coupled to an inner surface of the second side portion and can be pivotable between a locked position and an unlocked position. The opening can have first and second interconnected portions, the first portion having a width W1 and the second portion having a width W2 sized to receive the engagement post, W1 being narrower than W2. In order move the engagement member into the locked position wherein the post is disposed within the second portion of the opening, a user must exert force against the engagement member, causing the first portion of the opening to distort and allow the post to pass through. Once the post is disposed within the second portion, the first portion prevents the engagement member from inadvertently rotating with respect to the post. The coupling of the engagement member and the post thereby restrains the movement of the first and second side portions relative to one another. When the engagement member is in the unlocked position the post and the engagement member are spaced apart, thereby allowing relative movement of the first and second side portions.

In other embodiments, a locking mechanism can comprise a first segment coupled to, for example, an inner surface of the first side portion and a second segment coupled to, for example, an inner surface of the second side portion, the second segment actuatable (e.g., by sliding) between a locked position and an unlocked position. The first segment and second segments can comprise first and second angled surfaces configured to releasably engage one another when the locking mechanism is in the locked position.

In some embodiments, a folding knife comprises a handle portion comprising first and second, laterally spaced side portions defining a blade-receiving cavity therebetween. The first side portion can have an opening at a distal end portion, and the second side portion can have a pivot member coupled to and extending from an inner surface of the second side portion. The pivot member can have a main body, a neck portion narrower than the main body, and a head portion wider than the neck portion. The opening can have first and second interconnected portions, the first portion being wider than the second portion. The neck portion of the pivot member can be slidable between a locked position, wherein the neck portion is disposed within the second portion and the first and second side portions are restrained from lateral movement away from one another, and an unlocked position wherein the neck portion is disposed within the first portion of the opening and the folding knife may be easily disassembled.

The foregoing and other objects, features, and advantages of the invention will become more apparent from the following detailed description, which proceeds with reference to the accompanying figures.

BRIEF DESCRIPTION OF THE DRAWINGS

FIGS. 17A-17D show various views of the pivot mechanism of FIG. 11 in various configurations.

DETAILED DESCRIPTION

For purposes of this description, certain aspects, advantages, and novel features of the embodiments of this disclosure are described herein. The disclosed methods, apparatuses, and systems should not be construed as limiting in any way. Instead, the present disclosure is directed toward all novel and nonobvious features and aspects of the various disclosed embodiments, alone and in various combinations and sub-combinations with one another. The methods, apparatuses, and systems are not limited to any specific aspect or feature or combination thereof, nor do the disclosed embodiments require that any one or more specific advantages be present or problems be solved.

Although the operations of some of the disclosed methods are described in a particular, sequential order for convenient presentation, it should be understood that this manner of description encompasses rearrangement, unless a particular ordering is required by specific language. For example, operations described sequentially (e.g., assembly or disassembly of a folding knife) may in some cases be rearranged or performed concurrently. Moreover, for the sake of simplicity, the attached figures may not show the various ways in which the disclosed methods can be used in conjunction with other methods. As used herein, the terms "a", "an" and "at least one" encompass one or more of the specified element. That is, if two of a particular element are present, one of these elements is also present and thus "an" element is present. The terms "a plurality of" and "plural" mean two or more of the specified element.

As used herein, the term "and/or" used between the last two of a list of elements means any one or more of the listed elements. For example, the phrase "A, B, and/or C" means "A," "B," "C," "A and B," "A and C," "B and C," or "A, B, and C."

As used herein, the term "coupled" generally means physically coupled or linked. Two components that are coupled to the each other can be directly connected to each other or can be indirectly connected to each other with one or more intermediate elements between the coupled items.

The present disclosure concerns folding knives that can be more easily disassembled than some known folding knives, such as for cleaning or replacing a blade or other components. For example, folding knives disclosed herein can be manually disassembled, that is, disassembled without the use of additional tools (e.g., without a screwdriver, hex key, etc.). In some embodiments, disclosed folding knives include a handle having first and second side portions having complementary locking elements which can prevent the side portions from being separated from one another.

Figure 1:
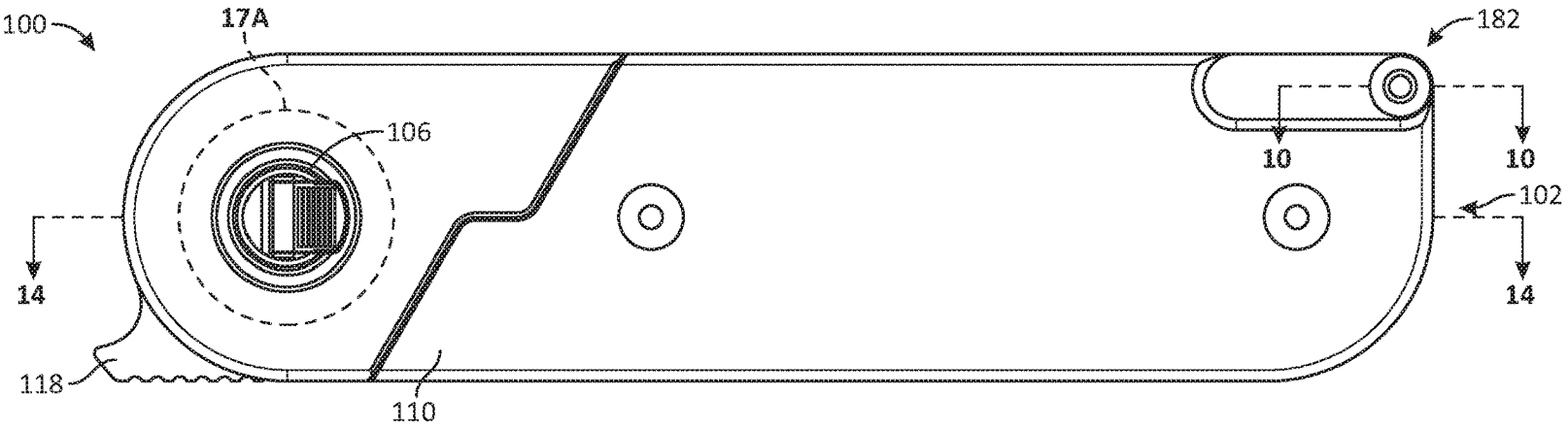
FIG. 1 shows a side view of an exemplary folding knife in a closed configuration.
Figure 3:
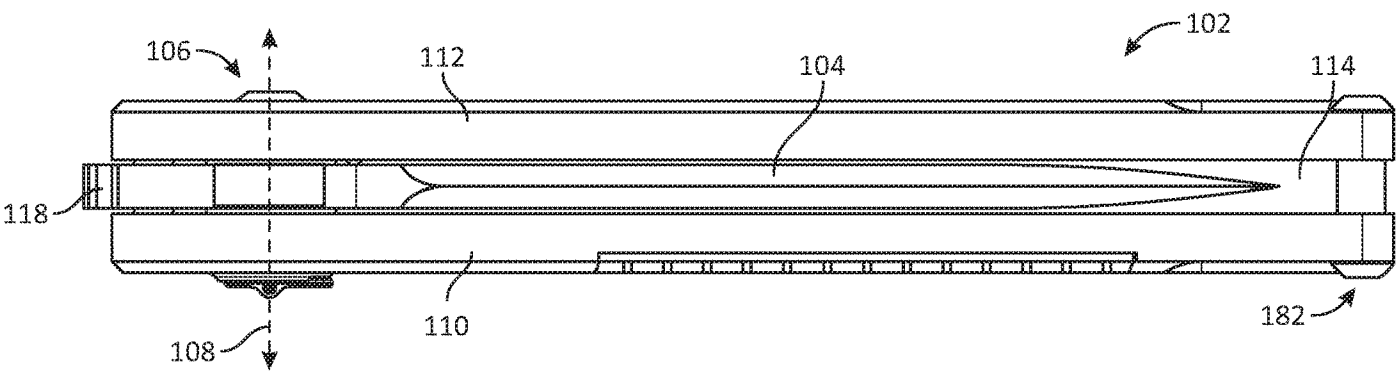
FIG. 3 shows a top view of the folding knife of FIG. 1.
Figure 2:
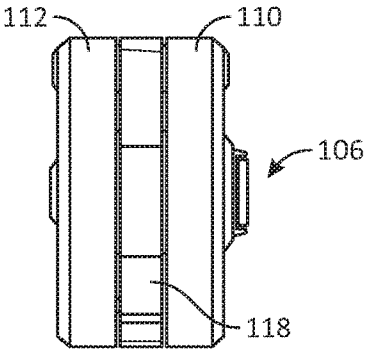
FIG. 2 shows an end view of the folding knife of FIG. 1.

FIGS. 1-20 show an exemplary embodiment of an easily disassembled folding knife 100 (also referred to as "the knife 100"). Referring to FIG. 3, the knife 100 can include three main components: a handle 102, a blade 104, and a pivot mechanism 106. The blade 104 can be pivotably connected to the handle 102 by the pivot mechanism 106 such that the blade 104 can be pivoted around a central axis 108 between an open position in which a cutting portion 109 of the blade 104 is exposed from the handle 102 (not shown) and a closed position in which the cutting portion 109 of the blade 104 is protected (at least partially) by the handle 102 (e.g., as shown in FIGS. 1-3).

The handle 102 can include a first side portion 110 and a second side portion 112. When the handle 102 is assembled, the first and second side portions 110, 112 can be spaced apart from each other by a distance, thereby defining a blade receiving channel 114 between the two side portions for receiving the blade 104 when it is pivoted to its closed position.

In some embodiments, the handle 102 can include a blade lock configured to selectively retain the blade in an open position during use. For example, the second side portion 112 of the handle 102 can comprise a frame or liner lock 116 (FIG. 8) that is biased into a position that engages a tang portion 117 (FIG. 7) of the blade 104 to retain the blade 104 in the open position. In other embodiments, the liner lock 116 can be a part of a separate inner liner of the handle that is disposed against the inner surface of the second side portion 112, as known in the art.

Figure 7:
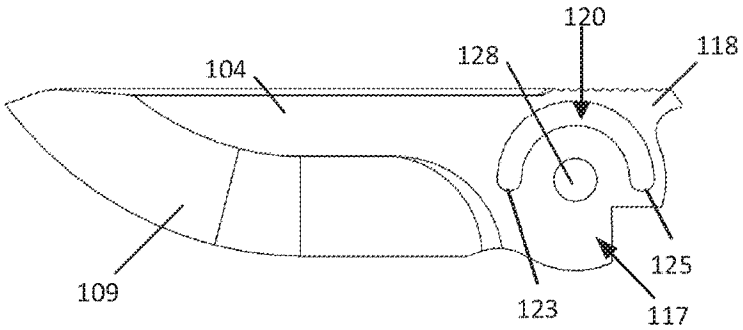
FIG. 7 shows a side view of a blade of the folding knife of FIG. 1.

Referring to FIG. 7, the blade 104 can include the cutting portion 109 and the tang portion 117, as mentioned above. The tang portion 117 can be used to couple the blade 104 to the pivot mechanism 106 (and thus to the handle 102).

In some embodiments, the tang portion 117 can include an extension 118 that protrudes beyond the handle 102 when the knife 100 is fully assembled and the blade 104 is in either an open or a closed position. The extension 118 can, for example, assist a user in opening/closing the blade 104.

The blade 104 can have a pivot opening 128 located in a tang portion 117 of the blade 104. The tang portion 117 of can also include a semi-circular slot 120, extending through the blade. The first side portion 110 can have a pin 122 (FIGS. 14 and 24) extending from an inner surface 103 of the first side portion 110. The pin 122 can be disposed in and translate (e.g., slide) relative to the slot 120 as the blade 104 is moved between the open and closed positions. The pin 122 can engage end surfaces 123, 125 of the slot 120 to stop rotation of the blade 104 at a fully open position and a fully closed position, respectively. In this manner, the pin 122 and the slot 120 interact to prevent the blade 104 from rotating 360 degrees relative to the handle 102. In particular embodiments, the pin 122 and the slot 120 are configured to permit rotation of the blade through 180 degrees between the open and closed positions.

Figure 4:
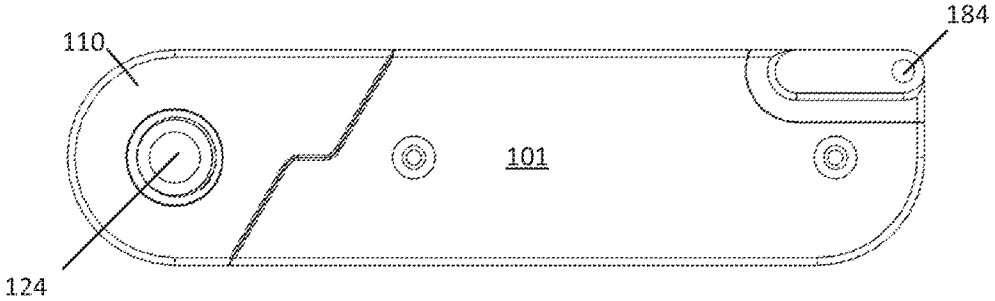
FIG. 4 shows a side view of an outer surface of a first side portion of the folding knife of FIG. 1.
Figure 5:
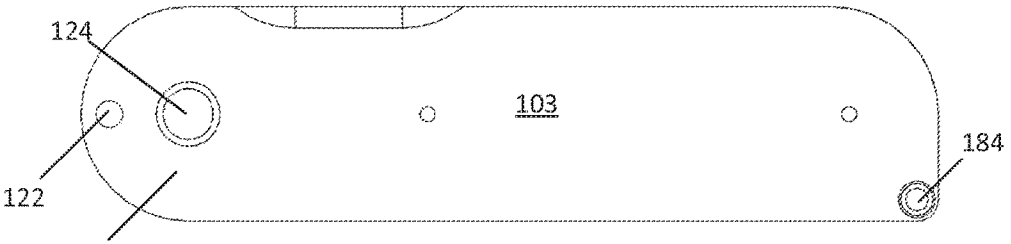
FIG. 5 shows a side view of an inner surface of a first side portion of the folding knife of FIG. 1.
Figure 6:
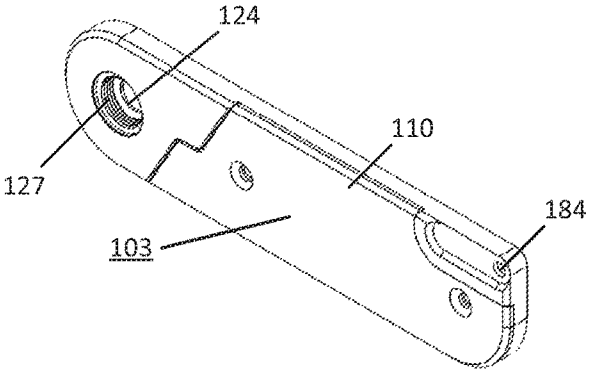
FIG. 6 shows a perspective view of the first side portion of FIG. 4.
Figure 8:
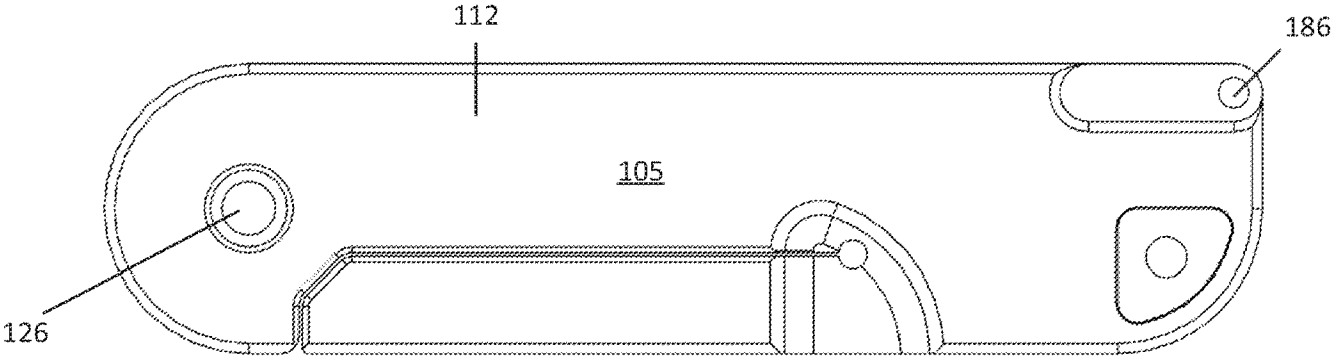
FIG. 8 shows a side view of an outer surface of a second side portion of the folding knife of FIG. 1.
Figure 9:
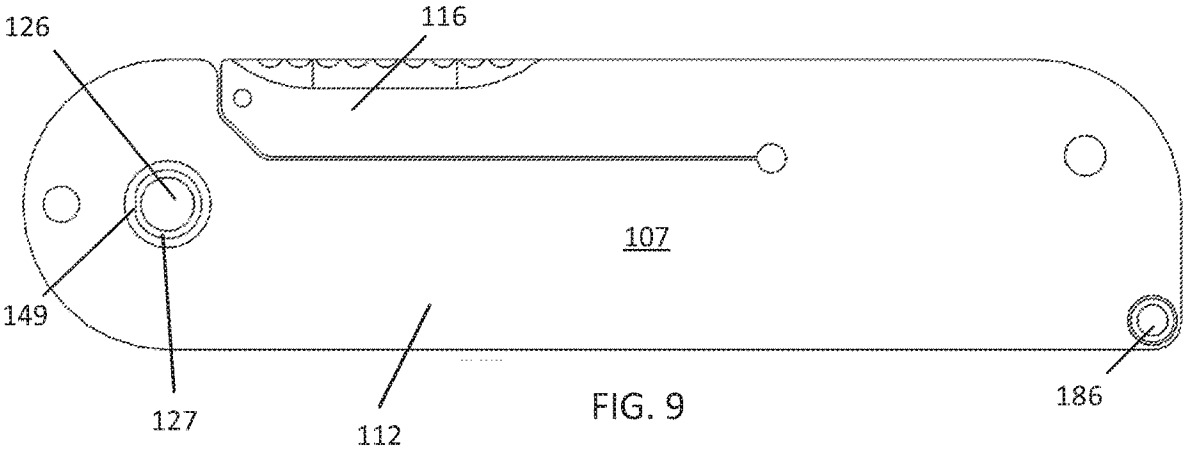
FIG. 9 shows a side view of an inner surface of a second side portion of the folding knife of FIG. 1.

As shown in FIGS. 4-6, the first side portion 110 of the handle 102 can have a first opening 124 located at a forward or distal end portion thereof and extending laterally through the first side portion 110 from an outer surface 101 to the inner surface 103. In some embodiments, as shown in FIG. 6, the annular surface defining the first opening 124 can comprise internal threads 127. In other embodiments, the annular surface can be non-threaded and a threaded insert can be disposed within the first opening 124. As shown in FIGS. 8-9, the second side portion 112 of the handle 102 can have a second opening 126 located at a rear or distal end portion thereof and extending laterally through the second side portion 112 from an outer surface 105 to an inner surface 107.

Figure 13:
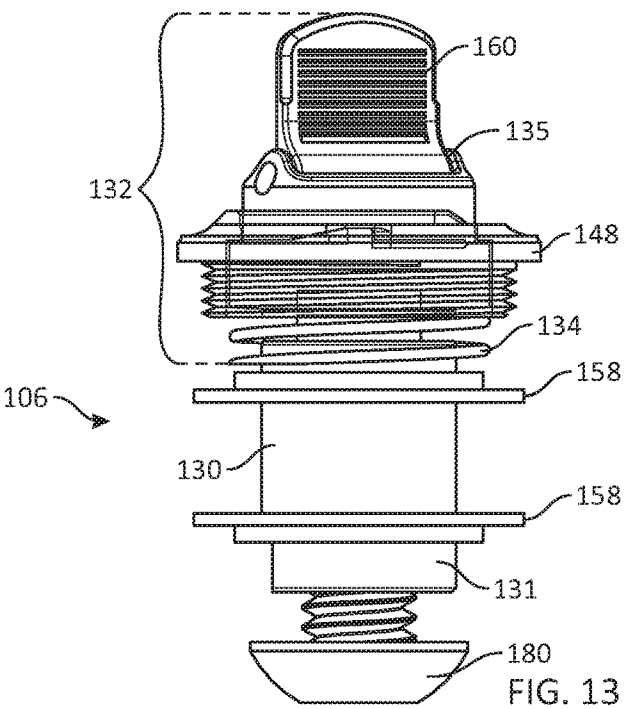
FIG. 13 shows a side view of the pivot mechanism of FIG. 11 in an assembled configuration.

Referring now to FIG. 13, the pivot mechanism 106 can include a pivot member 130 and a locking mechanism 132. Generally speaking, the pivot mechanism 106 can couple the blade 104 to the first and second side portions 110, 112 of the handle 102, and the blade 104 can pivot relative to the handle 102 about the pivot mechanism 106.

Figure 11:
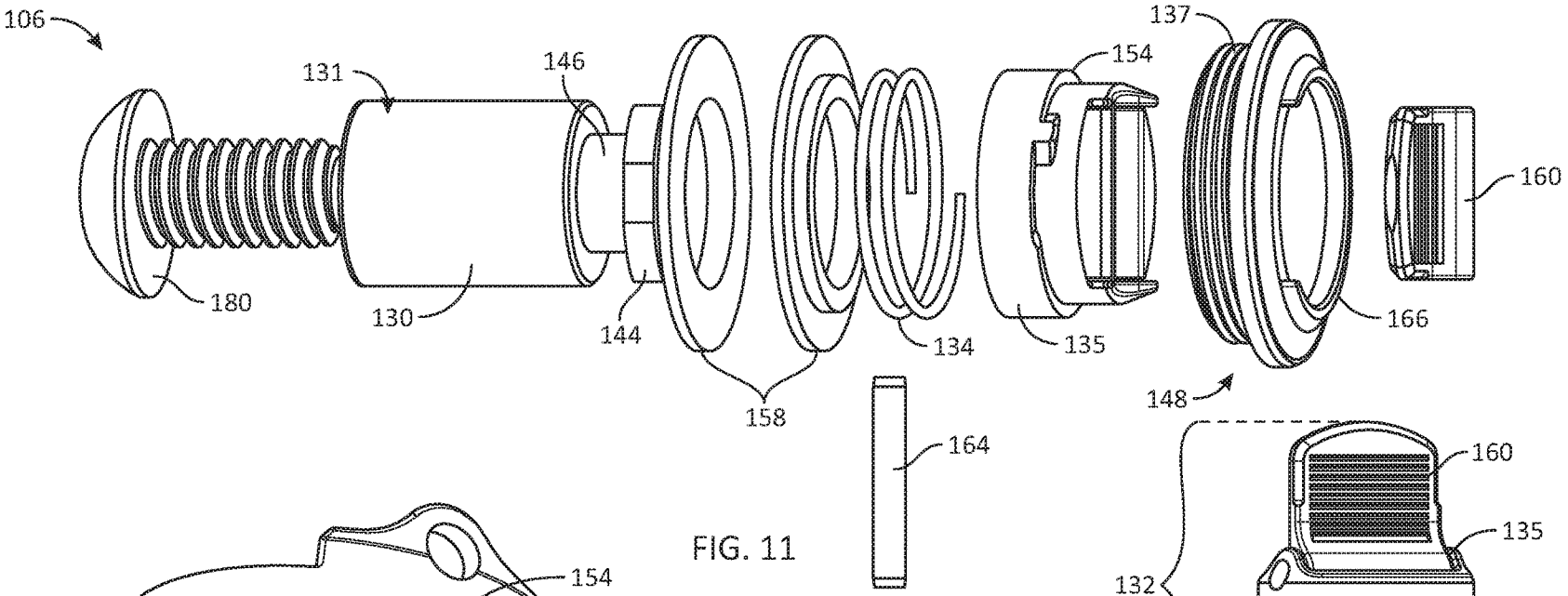
FIG. 11 shows an exploded perspective view of a pivot mechanism of the folding knife of FIG. 1.

Referring to FIG. 11, the pivot member 130 can have a cylindrical main body portion 131, a non-circular head portion 144, and a neck portion 146 disposed between the main body portion 131 and the head portion 144. The neck portion 146 can have a width (e.g., a diameter) that is narrower than the width (e.g., diameter) of the main body portion 131 and the head portion 144.

Figure 24:
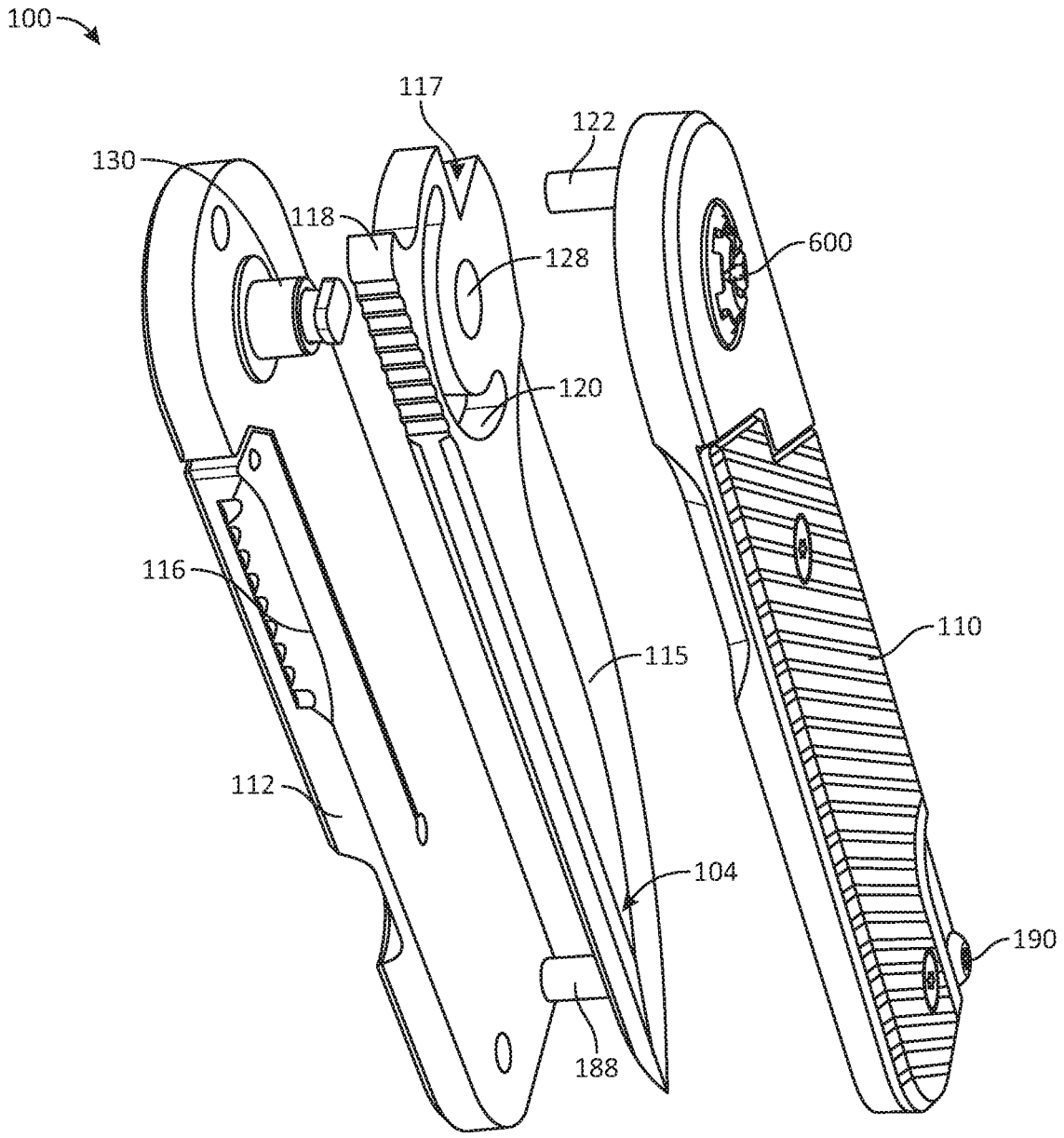
FIG. 24 shows an exploded perspective view of an exemplary folding knife of FIG. 1 with the pivot mechanism of FIG. 18.

The main body portion 131 can be coupled to and extend laterally from the inner surface 105 of the second side portion 112 of the handle 102, as shown in the FIG. 24. In some embodiments, the pivot member 130 and the second side portion 112 of the handle 102 can be formed as separate components that are coupled together with fasteners (e.g., a screw 180), a press fit, an adhesive, and/or other means for coupling. In some of those embodiments, the main body portion 131 can have a non-circular portion 147 (e.g., with a flat) (FIG. 14), and the second side portion 112 of the handle 102 can have a non-circular (e.g., "D"-shaped) recess 149 (FIG. 9) for receiving the non-circular portion 147 of the main body portion 131. The non-circular portion 147 and the non-circular recess 149 can, for example, prevent relative rotational movement between the pivot member 130 and the second side portion 112.

Figure 14:
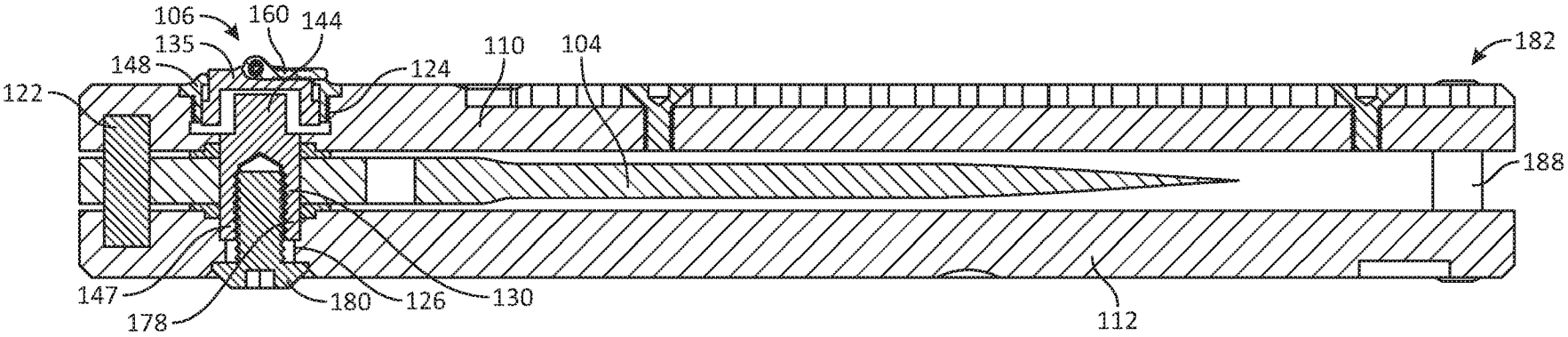
FIG. 14 shows a cross-sectional view of the folding knife of FIG. 1, taken along the line 14-14 shown in FIG. 1.

Referring to FIG. 14, the main body portion 131 of the pivot member 130 can extend laterally from the second side portion 112, through the pivot opening 128 (FIG. 7) of the blade 104. The head portion 144 of the pivot member 130 can be disposed in or extend through the first opening 124 of the first side portion 110 of the handle 102.

The locking mechanism 132 can be coupled to the first side portion 110 of the handle 102 and can selectively engage the head portion 144 of the pivot member 130 to releasably couple the blade 104 and the first and second side portions 110, 112 of the handle 102 together.

Figure 15:
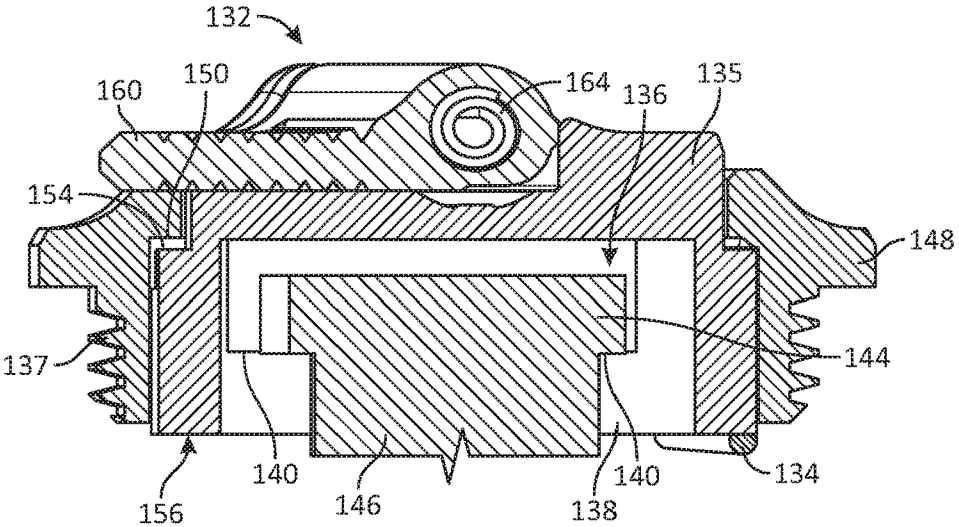
FIG. 15 shows a cross-sectional view of a portion of the pivot mechanism of FIG. 11.

Referring to FIG. 15, the locking mechanism 132 can comprise a collar 148 and a cap 135 disposed radially within the collar 148. The collar 148 can be coupled to the first side portion 110 of the handle 102 in various ways. For example, the collar 148 can have external threads 137 that are configured to engage the internal threads 127 of the first side portion 110 of the handle 102. The collar 148 can be coupled to the first side portion 110 in various other ways such as by a press fit, an adhesive, and/or other coupling means. In some embodiments, the collar 148 can be integrally formed with the first side portion 110 of the handle 102.

Figure 12:
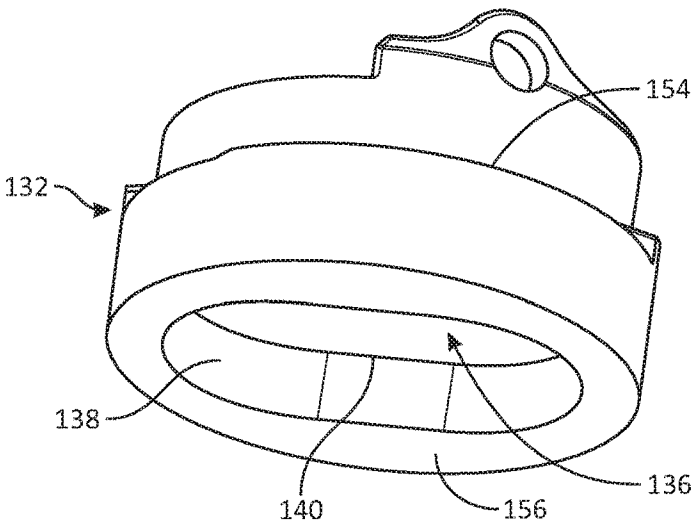
FIG. 12 shows a perspective view of a cap of the pivot mechanism of FIG. 11.

As shown in FIGS. 12 and 15, the cap 135 of the locking mechanism 132 can have an interior chamber or recess 136 and a non-circular opening or aperture 138 in communication with the interior recess 136. The interior recess 136 can have an inner diameter greater than a diameter of the aperture 138. As such, the cap 135 has an annular step or interior lip 140 extending radially from the inner surface of the recess to the inner surface of the aperture 138, as shown in FIGS. 17A-17B.

Referring to FIG. 15, the interior recess 136 of the cap 135 and the head portion 144 of the pivot member 130 can be sized and/or configured such that the head portion 144 can be received within the cap 135 when the knife is in an assembled state.

Figure 17B:
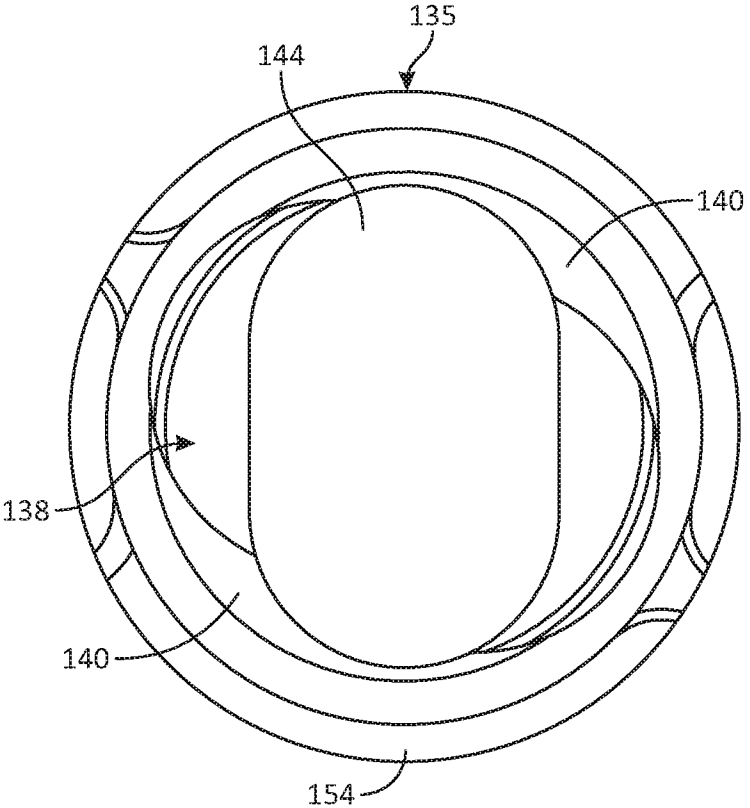
Figure 17A:
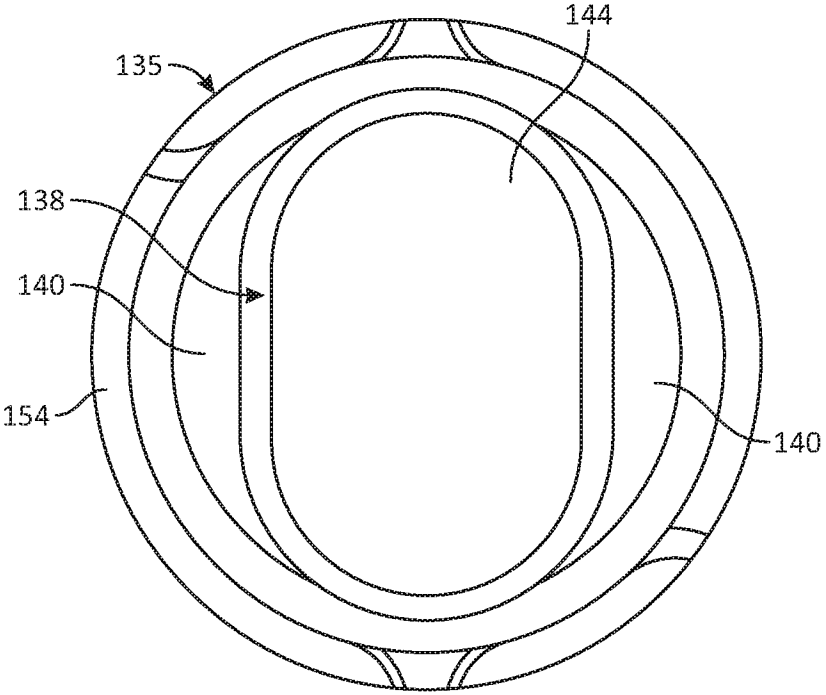

As shown in FIGS. 17A-17B, the aperture 138 of the cap 135 and the head portion 144 of the pivot member 130 can be sized and/or configured such that the head portion 144 can be inserted into or withdrawn through the aperture 138 when the aperture 138 and the head portion 144 are rotationally aligned (e.g., FIG. 17A) and such that of the head portion 144 cannot be inserted or withdrawn through the aperture 138 when the aperture 138 and the head portion 144 are rotationally offset (e.g., FIG. 17B) due to the engagement of the head portion 144 with the interior lip 140 of the cap 135.

As used herein, the term "rotationally aligned" means that the aperture 138 of the cap 135 is in a rotational position relative to the head portion 144 of the pivot member 130 about the central axis 108 extending through the aperture 138 and the head portion 144 such that the head portion can fit or slide through the aperture 138 in a direction along the central axis 108 (see, e.g., FIG. 17A). The term "rotationally offset" means that the aperture 138 is in a rotational position relative to the head portion 144 about the central axis 108 extending through the aperture 138 and the head portion 144 such that the head portion 144 cannot fit or slide through the aperture 138 in a direction along the central axis 108 (see, e.g., FIG. 17B) and such that the head portion 144 engages the interior lip 140 of the cap 135.

The cap 135 can be moved relative to the collar 148 to various positions. For example, the cap 135 can be moved relative to the collar 148 between a first position (e.g., a locked position, which corresponds to the rotationally offset position between the cap 135 and the head portion 144 of the pivot member 130), a second position (e.g., an unlocked position which corresponds to the rotationally aligned position between the cap 135 and the head portion 144 of the pivot member 130), and/or other positions.

As shown in FIG. 17A, when the aperture 138 and the head portion 144 are rotationally aligned, the outer periphery of the head portion 144 is spaced from the inner periphery of interior lip 140 of the cap 135 so as to define an annular gap or clearance between these two components, allowing the head portion 144 to be easily inserted into or removed from the cap. As shown in FIG. 17B, when the aperture 138 and the head portion 144 are rotationally offset, the head portion 144 overlaps and contacts the interior lip 140 of the cap 135, thus preventing removal of the head portion 144 from the cap 135.

In some embodiments, when the locking mechanism 132 is in the first rotational position (the unlocked position) there can be 0.015-0.03 inches of clearance between the outer surface of the head portion 144 of the pivot member 130 and the aperture 138 extending around the head portion 144 while the head portion 144 passes through the aperture 138. The clearance allows a user to assemble the knife without having to align the head portion exactly with the aperture.

While the illustrated embodiment includes a pivot member with a substantially oval-shaped head portion having oblong side portions and cap with a corresponding substantially oval-shaped aperture having oblong side portions, the head portion and the aperture of the cap can be any of various shapes, such as, without limitation, elliptical, square, triangular, cruciform (cross-shaped), flat-oval shaped (e.g., a shape comprising an oval with flat sides), rectangular, etc. It should be noted that in any of the embodiments disclosed herein, wherever a first component has a non-circular cross-sectional shape that fits through a correspondingly shaped opening in a second component, the shape of the first component and the opening can be any of various shapes, including by not limited to a square, hexagon, triangle, cruciform, oval, etc.

In certain embodiments, the shape of the aperture 138 need not correspond exactly to the cross-sectional shape of the pivot member 130. For example, the aperture 138 of the cap 135 can have any non-circular shape that is sized and shaped: (1) to allow the head portion 144 of the pivot member 130 to slide through the aperture 138 when the cap 135 is in a first rotational position (e.g., the unlocked position) in which the aperture 138 is rotationally aligned with the head portion 144 and (2) to block the head portion 144 from sliding through the aperture 138 when the cap 135 is in a second rotational position (e.g., the locked position) in which the aperture 138 is rotationally offset from the head portion 144, causing the head portion to engage with the interior lip 140 of the cap 135.

Referring to FIGS. 17A-18, the cap 135 can also have an exterior lip or outer shoulder 154 that extends circumferentially around the cap 135. The outer shoulder 154 of the cap 135 can be configured to engage a flange 150 of the collar 148, as shown in FIG. 15. Referring to FIGS. 13-15, a biasing member (e.g., a spring such as a compression spring 134) can be disposed between the blade 104 and an inner surface 156 of the cap 135 (i.e., the lower surface of the cap 135 in the orientation shown in FIG. 15). In this manner, the spring 134 can exert a force (i.e., an upward force in the orientation shown in FIG. 15) on the cap 135 that biases the outer shoulder 154 of the cap 135 toward the flange 150 of the collar 148. The spring 134 can be disposed within the first opening 124 of the first side portion 110 and can be retained within the first opening 124 by any of various suitable means, for example, by a bushing 158 situated within the first opening. The bushing 158 can be secured within the opening, such as with an adhesive or a press-fit configuration, to prevent the bushing from being removed when the knife is disassembled. In the illustrated embodiment, one end of the spring 134 bears against an adjacent bushing 158 and the other end of the spring 134 bears against the adjacent inner surface 156 of the cap 135 so as to urge the cap 135 laterally away from the blade 104 and the second side portion 112.

When the cap is in the locked position, the biasing force exerted by the spring 134 against the cap causes the outer shoulder 154 of the cap 135 to engage the flange 150 of the collar 148 as well as causes the head portion 144 of the pivot member 130 to abut against the interior lip 140 of the cap, thereby resisting inadvertent rotation of the head portion 144 within the interior recess 136 of the cap.

As noted above, the cap 135 can be manually rotated relative to the collar 148 and the pivot member 130. In particular embodiments, rotation of the cap 135 causes the cap to move axially within the collar 148, the significance of which is described in detail below.

To facilitate relative movement between the cap 135 and the collar 148, the cap 135 can include various features. For example, the cap 135 can have an actuator or lever 160. The lever 160 can be formed integrally with or coupled to the cap 135 and can be actuated by a user to rotate the cap 135 between the locked and unlocked positions.

In some embodiments, the actuator may be a lever and/or a button. In other embodiments, the actuator can be a D-ring, an O-ring, or other protrusion sized to allow a user to press and/or grasp the actuator with his or her fingers and/or thumb and rotate the actuator in order to lock and/or unlock the knife 100.

Figure 16:
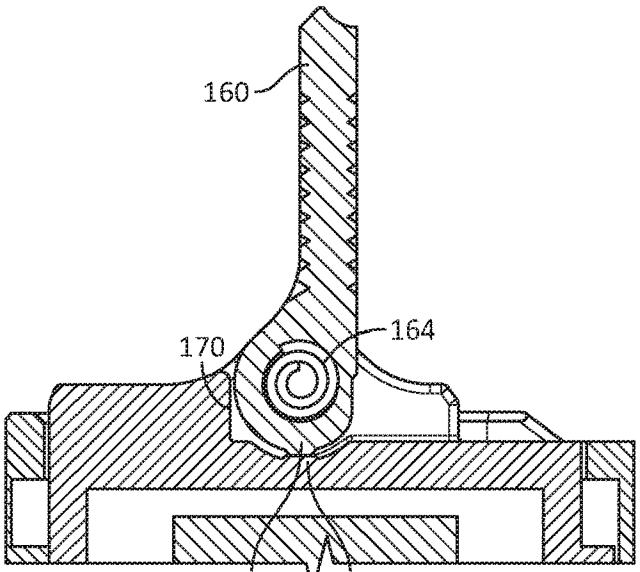
FIG. 16 shows a cross-sectional view of a portion of the pivot mechanism of FIG. 11.

Referring now to FIGS. 14-16, in some embodiments, the lever 160 can be pivotably coupled to the cap 135 using a hinge spring 164, or by various other suitable means. The lever 160 can be moved between a horizontal or stored position (see FIG. 20A), in which the lever is substantially parallel to the outer surface 101 of the first side portion 110 and a vertical or use position (see FIG. 20B), wherein the lever 160 extends along central axis 108 extending through the aperture 138 and the head portion 144, such that the lever 160 is substantially perpendicular to the outer surface 101 of the first side portion 110. When in the vertical position, the lever 160 can be manually rotated to rotate the cap 135 between the locked (FIG. 20C) and unlocked (FIG. 20D) positions.

Figure 20B:
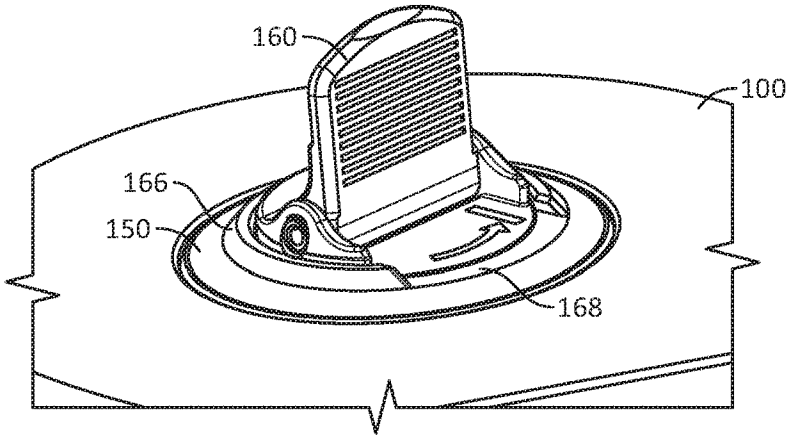
FIGS. 20A-20D show various views of the locking mechanism of FIG. 11 in various configurations.
Figure 20D:
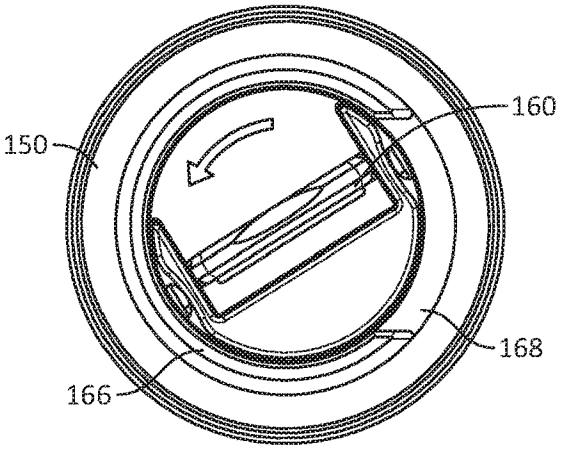
Figure 20A:
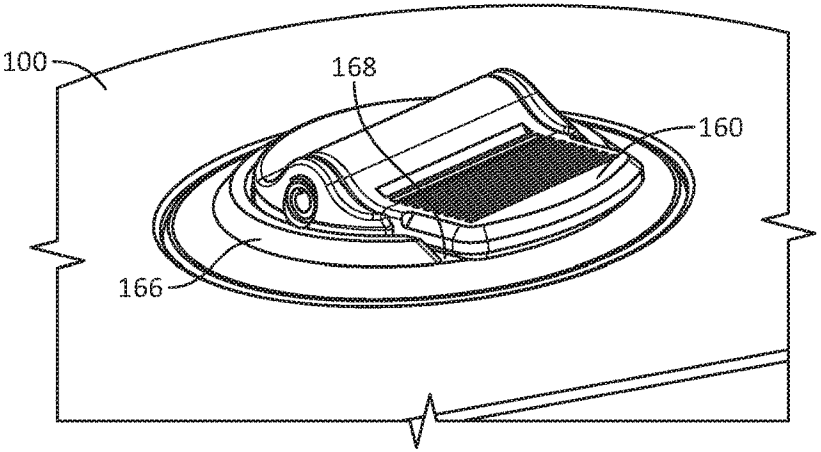

Referring to FIGS. 20A-20D, the collar 148 can comprise a retention lip 166 having a retaining recess 168 sized such that the free end portion of the lever 160 (the free end portion being the end portion opposite the end portion connected by the hinge) can be seated within the retaining recess 168 when the lever 160 is in the horizontal position (FIG. 20A). The inner surface of the retaining recess 168 can be shaped and sized to frictionally engage the free end portion of the lever 160, thus preventing the lever from pivoting out of the recess until acted upon by a user.

Referring to FIG. 16, the cap 135 can comprise surface features (e.g., first and second detent elements 170) at locations corresponding to the horizontal and vertical positions of the lever 160 such that when the lever is in the horizontal or vertical position a protrusion 172 on the lever 160 engages the first or second detent element 170 to selectively retain the lever in the horizontal and/or vertical position until acted upon by a user. The hinge spring 164 can exert a biasing force to help retain the protrusion of the lever within the first or second detent element.

The cap 135 and/or the collar 148 can have various other features to facilitate or restrict relative movement between them. For example, in some embodiments, the outer shoulder 154 of the cap 135 and/or the flange 150 of the collar 148 can be ramped, as shown in FIGS. 18-19. In use, rotating the cap 135 relative to the head portion 144 causes the ramped surfaces of the outer shoulder 154 and the flange 150 to engage one another, thus causing the cap 135 to move axially within the collar. When rotating the cap 135 from the unlocked position to the locked position, the cap 135 is moved axially away from the blade 104 (e.g., upward in the orientation shown in FIG. 15) so that the interior lip 140 of the cap bears tightly against the adjacent surface of the head portion 144. When rotating the cap 135 from the locked position to the unlocked position, the cap 135 is moved axially toward the blade 104 (e.g., downward in the orientation shown in FIG. 15) so that the interior lip 140 of the cap backs away from and no longer contacts the adjacent surface of the head portion 144 of the pivot member 130.

Figure 18A:
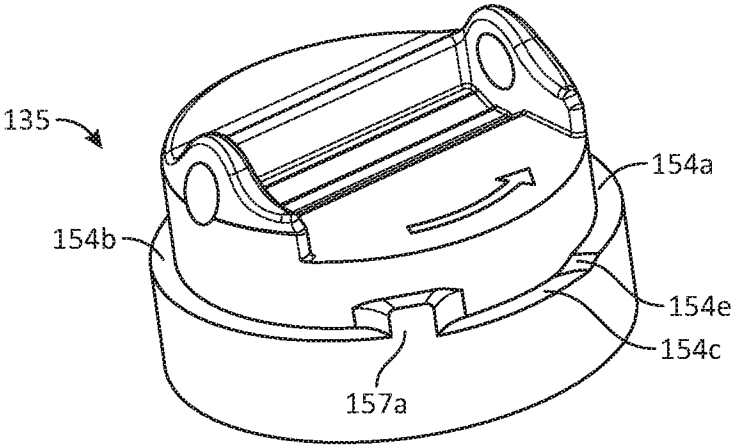
FIGS. 18A and B show perspective and top plan views, respectively, of the cap of the pivot mechanism of FIG. 11.
Figure 18B:
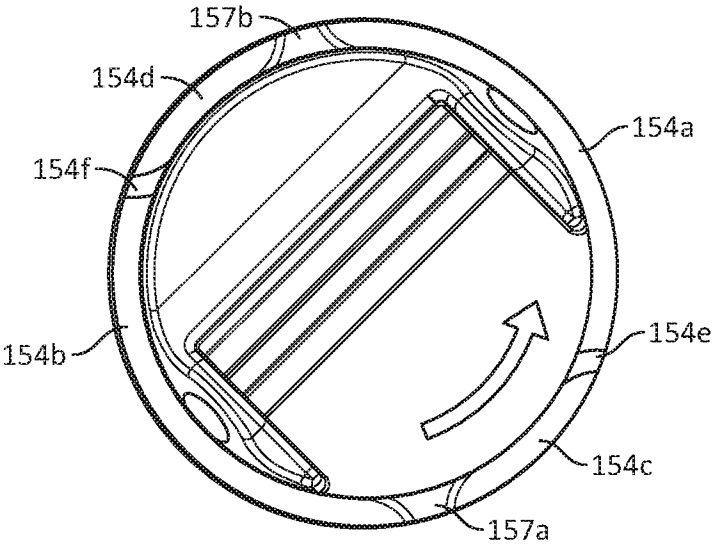

The cap 135 and/or the collar 148 can include surface features that vary the rotational resistance of the cap relative to the collar as the cap is rotated from the locked position to the unlocked position and vice versa. In particular, the cap 135 and/or the collar 148 have features that provide relatively high rotational resistance for the cap closer to the locked position and relatively less rotational resistance for the cap closer to the unlocked position Explaining further, as shown in FIGS. 18A and B, the outer shoulder 154 in the illustrated embodiment further includes first and second upper surface portions 154*a*, 154*b*, first and second lower surface portions 154*c*, 154*d* axially spaced from the upper surface portions by inclined or ramped surface portions 154*e*, 154*f*, and first and second stops 157*a*, 157*b* in the form of tabs or protrusions. The first and second stops 157*a*, 157*b* can be located at diametrically opposed locations around a circumference of the outer shoulder 154. As best shown in FIG. 18B, each lower surface portion 154*c*, 154*d* extends circumferentially from a stop 157*a*/157*b* to a ramped surface portion 154*e*/154*f* and each upper surface portion 154*a*, 154*b* extends circumferentially from a ramped surface portion 154*e*/154*f* to another stop 157*a*/157*b*, moving in a counterclockwise direction in FIG. 18B.

Figure 19A:
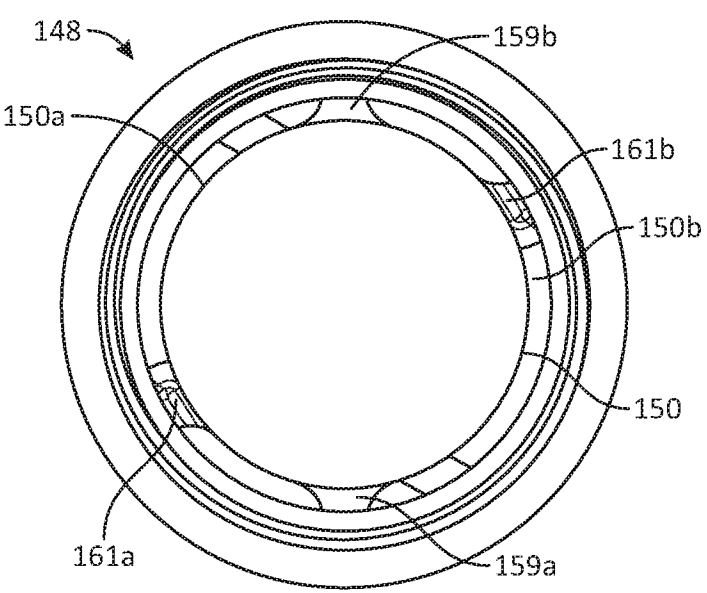
FIG. 19A-19B show bottom plan and perspective views of the collar of the pivot mechanism of FIG. 11.
Figure 19B:
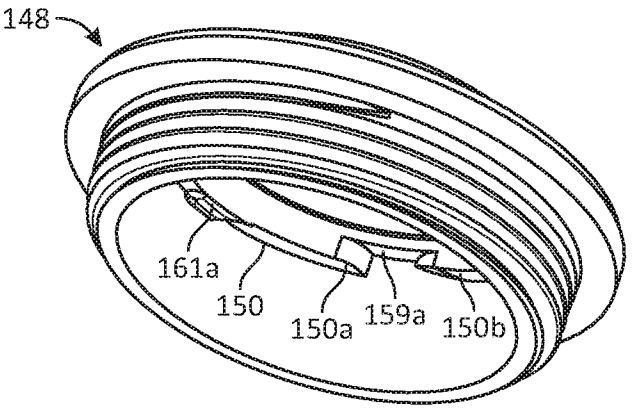

As shown in FIGS. 19A and 19B, the flange 150 includes first and second ramped surface portions 150*a*, 150*b* and first and second circumferentially spaced notches 159*a*, 159*b* (also referred to as "the notches 159"). The notches 159*a*, 159*b* can be located at diametrically opposed locations around a circumference of the collar so as to correspond to the locations of the first and second stops 157*a*, 157*b* on the cap 135. Each ramped surface portion 150*a*, 150*b* extends circumferentially from one notch 159*a*/159*b* to another notch 159*a*/159*b*. The collar can further include first and second protrusions 161*a*, 161*b* extending from the first and second ramped surfaces portions 150*a*, 150*b*.

When the cap 135 is in the locked position, the first and second stops 157*a*, 157*b* reside within the notches 159*a*, 159*b*, the first and second protrusions 161*a*, 161*b* of the collar 148 contact the lower surface portions 154*c*, 154*d* of the cap 135, and the interior lip 140 of the cap 135 contacts the adjacent surface of the head portion 144 of the pivot. In this position, the cap 135 is held firmly in place against axial movement (movement in the direction parallel to the pivot axis) and holds the handle side portions together by virtue of contact with the first and second protrusions 161*a*, 161*b* on one side of the cap and contact with the head portion on the other side of the cap (see FIGS. 15 and 17B). As noted above, the biasing force of the spring 134 against the cap 135 resists inadvertent rotation of the cap to maintain the cap in the locked position during normal use of the knife.

As the cap 135 is initially rotated to the unlocked position, the resistance against rotation is initially relatively high due to the frictional contact of the engaging surfaces between the cap and the collar and between the cap and the head portion. As the cap 135 continues to rotate, the ramped surfaces 154*e*, 154*f* of the cap contact the first and second protrusions 161*a*, 161*b* of the collar, causing the cap 135 to move inwardly into the handle toward the blade so that the interior lip moves away from the adjacent surface of the head portion 144. Movement of the cap away from the head portion reduces frictionally contact on the rotating cap, thereby providing a noticeable decrease in rotational resistance against the cap. Upon further rotation of the cap, the upper surfaces 154*a*, 154*b* can slide along the first and second protrusions 161*a*, 161*b* of the collar until the first and second stops 157*a*, 157*b* contact the protrusions 161*a*, 161*b*, preventing further rotation of the cap at the unlocked position in which the head portion 144 is rotationally aligned with the aperture 138 in the cap 135 (see FIG. 17A), allowing the knife to be disassembled.

Conversely, when rotating the cap in the opposite direction from the unlocked position to the locked position, there is initially a small amount of resistance against rotation until the ramped surfaces 154*e*, 154*f* contact the first and second protrusions 161*a*, 161*b*, allowing the cap 135 to move outwardly from the handle under the force of the spring 134. As the lower surfaces 154*c*, 154*d* come into contact with the first and second protrusions 161*a*, 161*b* and the interior lip 140 comes into contact with the head portion 144, the resistance against rotation noticeably increases. Further rotation is prevented when the first and second stops 157*a*, 157*b* enter the notches 159*a*, 159*b*.

In the illustrated embodiment, the cap and the collar are configured such that the cap is rotated about 120 degrees between the locked position and the unlocked position. However, one or more of the spacing and positioning of the first and second stops 157*a*, 157*b*, the ramped surfaces 154*e*, 154*f*, the notches 159*a*, 159*b*, and the first and second protrusions 161*a*, 161*b* can be varied as desired to vary the degree of rotation of the cap.

In other embodiments, the interior lip 140 (FIGS. 17A-17B) of the locking mechanism may be a ramped surface that increases in height. In this way, as the head portion 144 slides against the ramped interior lip 140, the frictional contact between the head portion and the lip increases, and the spacing between the first and second side portions 110, 112 decreases to hold the side portions and the blade 104 tightly in their assembled state. The frictional contact can also resist movement of the head portion within the interior recess of the locking mechanism.

Referring now to FIG. 14, in some embodiments, the pivot member 130 can have a threaded bore 178 formed in a second end portion of the pivot member, opposite the head portion 144. The threaded bore 178 can be configured to accept a screw 180 or another type of fastener to secure the pivot member 130 to the second side portion 112. The screw 180 can extend through the second opening 126 in the second side portion 112 and can be tightened into the threaded bore 178 of the pivot member 130, releasably coupling the pivot member 130 to the second side portion 112. Alternatively, in other embodiments, the pivot member can be formed integrally with the second side portion such that the pivot member extends from an inner surface 107 of the second side portion 112, or the pivot member 130 can be formed separately and be permanently coupled to the second side portion by welding, adhesive, and/or other means of coupling.

Figure 10:
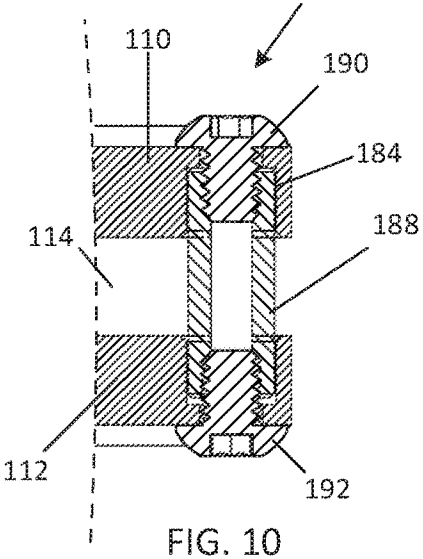
FIG. 10 shows a partial cross-sectional view of the folding knife of FIG. 1, taken along the line 10-10 shown in FIG. 1.

Referring now to FIG. 10, in some embodiments, to further secure the two halves of the handle of the knife to one another, a secondary securing mechanism 182 can be provided which can help to ensure that the two halves do not inadvertently rotate with respect to each other and thereby become unfastened. A variety of such mechanisms can be used, and one example is shown in FIGS. 1-25.

As is shown in FIGS. 4-6, the first side portion 110 can include a first opening or recess 184 formed on the inner surface 103 of the first side portion 110 and extending at least partially through the first side portion 110. As is shown in FIGS. 8-9, in some embodiments, the second side portion 112 can include a second opening or recess 186 formed on an inner surface 107 of the first side portion 110 and extending at least partially through the second side portion 112. The second side portion 112 can have a post 188 (FIGS. 10 and 14) extending from an inner surface 107 of the second side portion 112. As shown in FIG. 10, when the knife 100 is in the assembled configuration, the post 188 can be releasably coupled to both the first and second side portions 110, 112 using, for example, screws 190 and 192, which can be tightened into opposing ends of the post 188 in the assembled configuration.

The post 188 can be coupled to the first and second side portions 110, 112 such that when the forward end portions (e.g., the end portions nearest the blade) of the first and second side portions 110, 112 are disconnected from each other, they can pivot with respect to one another about the post 188 while both side portions remain coupled to the post 188. In such embodiments, during assembly the first and second side portions 110, 112 can be pivoted about the post 188 such that the forward end portions of the first and second side portions 110, 112 move toward one another until the aperture 138 of the cap 135 is aligned with the head portion 144 of pivot member 130. It may be necessary for a user to apply a slight lateral force to the forward end portions of the first and second side portions to pull them laterally apart from one another such that the pivot opening 128 of the blade can be disposed over the pivot member 130 and the head portion 144 of the pivot member 130 can be aligned with the locking mechanism 132.

In other embodiments, the post 188 can be permanently coupled to or integrally formed with the second side portion 112. During disassembly, the post 188 can slide out of or otherwise disengage from the first recess 184 in the first side portion 110 as the first and second side portions 110, 112 are laterally separated, allowing the knife to separate into its component parts.

In some embodiments, the first side portion 110 can be formed integrally with the collar 148 and/or the pin 122 (i.e., one or more of these components can be machined or otherwise formed from a single piece of material). Alternatively, each of these components can be formed separately and joined later in the fabrication process, such as by welding. The collar 148 can be a separate component that is removably secured to the first side portion 110, such as by threaded engagement with the internal threads 127 of the first side portion 110 (such as in FIGS. 1-25), by adhesive, or by using a press-fit configuration, to prevent the cap 135 and collar 148 from being removed when the knife is disassembled.

In some embodiments, the second side portion 112 can be formed integrally with the pivot member 130 and/or the post 188 (i.e., one or more of these components can be machined or otherwise formed from a single piece of material). Alternatively, each of these components can be formed separately and joined later in the fabrication process, such as by welding. In other embodiments, the pivot member 130 can be a separate component that is removably secured to the second side portion, such as with screw 180 (as in FIGS. 1-25) or another type of removable fastener.

In some embodiments, as shown in FIGS. 1-25, the spring 134 and the cap 135 can be retained within the first opening 124 by the collar 148 at a first end of the first opening and by a bushing 158 at a second end of the opening. The bushing 158 can be secured within the opening, such as with an adhesive or a press-fit configuration, to prevent the bushing from being removed when the knife is disassembled. In some embodiments, the knife 100 can comprise a plurality of bushings 158 disposed at a first end of the second opening, which serves to help the blade 104 pivot by creating a substantially smooth surface adjacent the pivot mechanism 106. As shown in FIG. 24, in some embodiments, the bushings 158 allow the knife 100 to be disassembled into three portions.

Each of the components of the knife 100 can be formed of various materials, including metals, plastics, and/or composites. In embodiments wherein at least the first side portion comprises a plastic and/or other non-metal material, an additional threaded flange can disposed within the first opening 124 in order to retain the locking mechanism 132 within the first opening and provide a threaded surface to receive the threaded portion of the collar 148.

With the various components thus described, assembly and disassembly of the knife 100 will now be explained.

To assemble the knife 100, the pivot opening 128 of the blade 104 can be laid over the pivot member 130 extending from the second side portion 112. The first side portion 110 can be laid over the second side portion 112 with the aperture 138 of the cap 135 (which is retained within the first opening 124 of the first side portion 110 by the collar 148) in rotational alignment with the head portion 144 of the pivot member. Placing the cap 135 in the unlocked position aligns the aperture 138 with the head portion 144. The head portion 144 can then be pushed through the aperture 138 and into the interior recess 136 of the cap 135. In this position the neck portion 146 of the pivot member is situated within the aperture 138, as shown in FIGS. 14-15.

Figure 20C:
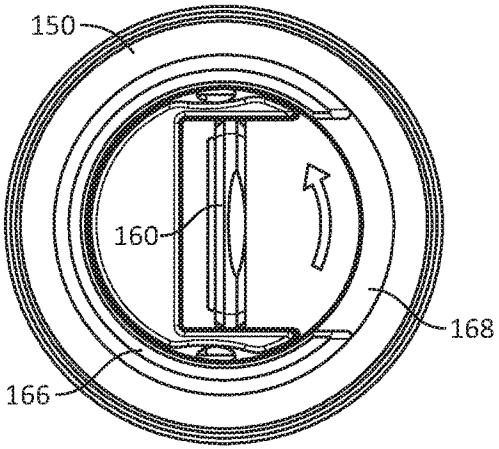

The user can then rotate lever 160 (when in the vertical position as shown in FIG. 20B) from the unlocked position to the locked position (as shown in FIGS. 20C and 20D) thus rotating the cap 135 around the head portion 144 of the pivot member 130. Rotating the cap 135 around the head portion 144 of the pivot member 130 moves the head portion 144 from a rotationally aligned configuration (FIG. 17A)

wherein the head portion 144 can be removed from the interior recess 136, to a rotationally offset configuration (FIG. 17B) wherein the head portion 144 abuts the interior lip 140 and is restrained from rotational movement, thereby locking the first side portion 110 to the second side portion 112. That is, first side portion 110 is restrained against lateral motion away from the second side portion 112 by the engagement of the head portion 144 with the interior lip 140 of the cap 135. Once the cap 135 is in the locked position, the user can pivot the lever 160 from the vertical position into the horizontal position (see FIG. 20A) within the retaining recess 168, thus restraining the lever 160 from rotational motion.

In embodiments comprising a secondary securing mechanism 182, prior to laying the first side portion 110 over the second side portion 112, the post 188 of the secondary securing mechanism can be aligned with the first recess 184 of the first side portion 110 such that when the first side portion is laid over the second side portion the post 188 is situated within the first recess 184.

To disassemble the knife 100, a user can actuate (e.g., manually) the lever 160 from the horizontal position (FIG. 20A), to the vertical position (FIG. 20B), and then rotate the lever 160 from the locked position (FIG. 20C) to the unlocked position (FIG. 20D). Rotating the cap 135 causes the cap 135 to move axially toward the second side portion 112 (e.g., downwards in the orientation shown in FIG. 15) against the spring 134 such that the head portion 144 no longer engages the interior lip 140 of the cap 135 and the head portion 144 becomes rotationally aligned with the aperture 138 of the cap. The components of the knife 100 can then be removed from one another laterally.

In embodiments wherein the knife comprises a blade lock that is separate from the second side portion 112 (e.g., liner lock 116), during assembly of the knife, the blade lock can be positioned over the second side portion 112, with the pivot member 130 extending through a respective opening in the blade lock. The blade 104 can then be laid down over the blade lock such that the pivot member 130 extends through the pivot opening 128 in the blade 104. The first side portion 110 can then be laid down over the blade 104 and the knife 100 can be further assembled and/or disassembled as described above.

In some embodiments, in lieu of lever 160, the cap 135 of the knife 100 can comprise a textured surface (not shown). In such embodiments, the knife 100 can be assembled and/or disassembled essentially as described above. To disassemble the knife, a user can exert a force on the surface, holding it in place relative to the user's finger, and pivot the handle 102 of the knife 100 relative to the surface and therefore the cap. Pivoting the handle 102 causes the collar 148 to pivot, allowing the ramped portion of the flange 150 to slide against the outer shoulder 154 of the cap 135 causing the cap to move axially (e.g., downwards in the orientation shown in FIG. 13) against the compression spring and causes the head portion 144 of the pivot member 130 to rotate within the interior recess 136 of the cap 135, moving the head portion 144 from the locked position to the unlocked position. Once unlocked, the components of the knife 100 can be separated from one another laterally.

FIGS. 21-25 illustrate another embodiment of the knife 100 having a locking mechanism 600 comprising a cap 602 and a collar 604 in lieu of locking mechanism 132 having cap 135 and collar 148. The other components of the folding knife are as described above.

Figure 21:
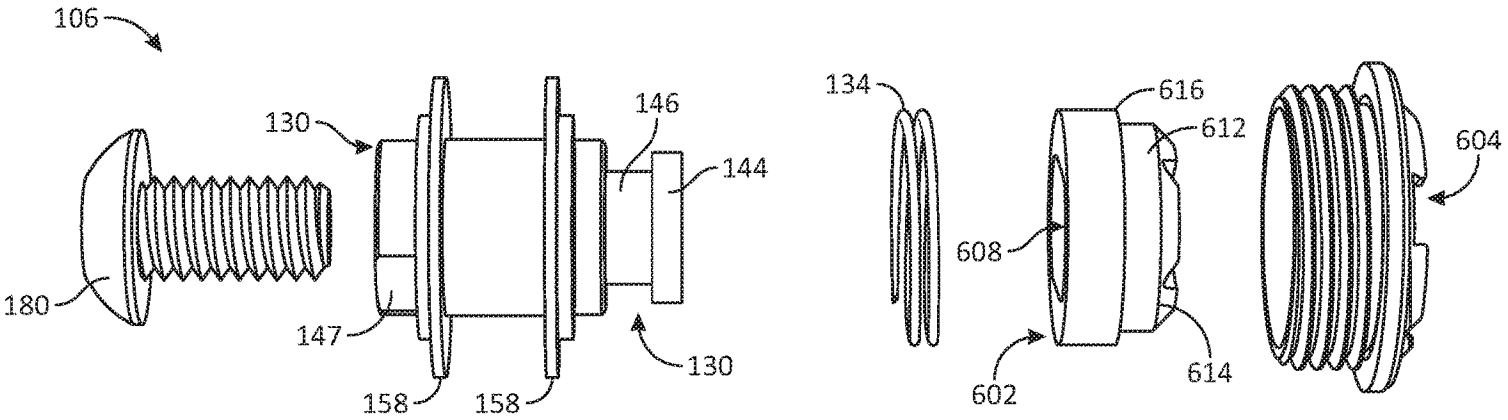
FIG. 21 shows an exploded view of another exemplary pivot mechanism.
Figure 25A:
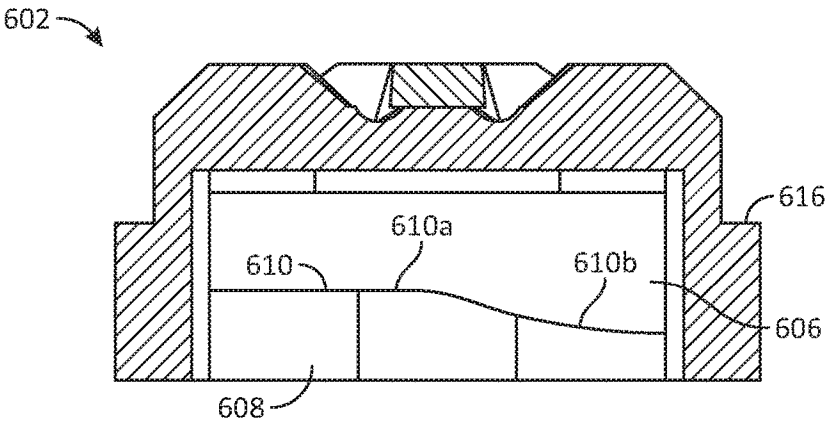
FIGS. 25A-25C show cross sectional, top plan, and perspective views of the cap of the pivot mechanism of FIG. 18.

Referring now to FIG. 25A, the cap 602 can comprise an interior chamber or recess 606 and a non-circular aperture 608 (also see FIG. 21). The interior recess 606 can have an inner diameter greater than a diameter of the aperture 608. As such, the cap 602 has an interior lip 610 that surrounds the aperture 608.

Figure 23:
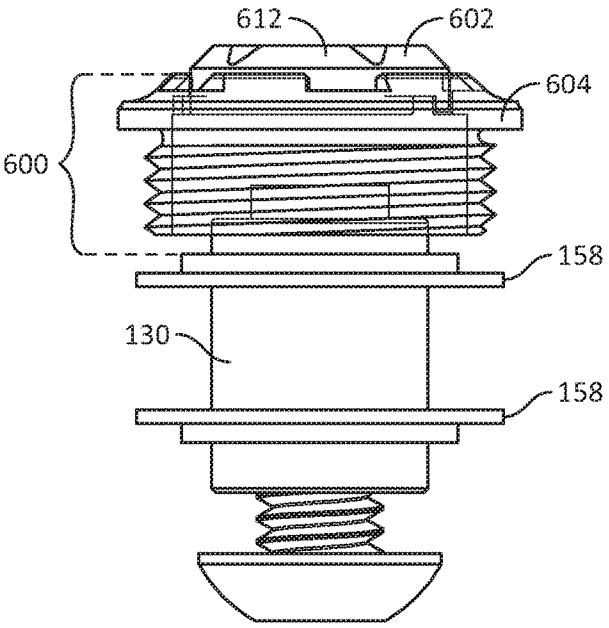
FIG. 23 shows a side view of the pivot mechanism of FIG. 18 in an assembled configuration.
Figure 22:
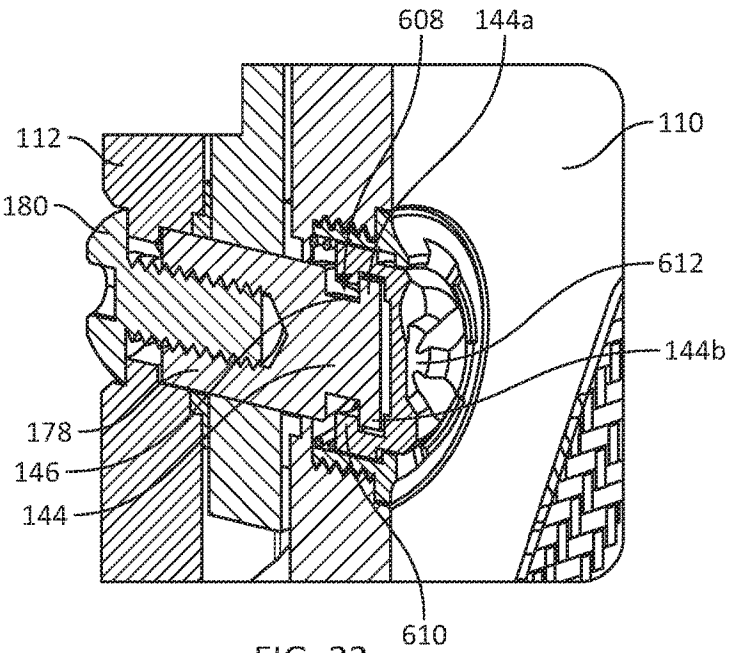
FIG. 22 shows a cross-sectional view of the pivot mechanism of FIG. 18 used with the folding knife of FIG. 1.

As shown in FIGS. 22-23, the interior recess 606 of the cap 602 and the head portion 144 of pivot member 130 can be sized and/or configured such that the head portion 144 can be inserted into or withdrawn through the aperture 608 when the aperture 608 and the head portion 144 are rotationally aligned, and such that the head portion 144 cannot be inserted into or withdrawn through the aperture 608 when the aperture 608 and the head portion 144 are rotationally offset.

To facilitate relative movement between the cap 602 and the collar 604, the cap 602 can include various features. For example, the cap 602 can function as a button having a protrusion 612 that can be rotated by a user to rotate the cap 602 between the locked and unlocked positions.

The cap 602 can be configured to be moveable laterally between a depressed position (closer to the blade 104 and the second side portion 112) and a raised position (further away from the blade 104 and the second side portion 112) (FIG. 23). The spring 134 can be configured to exert a biasing force against an inner surface of the cap (e.g., a bottom surface in the configuration shown in FIG. 23), biasing the cap 602 and thus the protrusion 612 into the raised position. When in the raised position an outer shoulder 616 of the cap 602 engages a shoulder (not shown) of the collar 604. A user can manually press the protrusion 612 of cap 602 to overcome the biasing force of the spring 134 and move the cap 602 into the depressed position. Referring to FIG. 22, when the cap 602 is in the locked and raised position (e.g., when not being depressed by a user), the biasing force exerted by the spring 134 causes the interior lip 610 of the cap 602 to engage the head portion 144 of the pivot member 130, resisting inadvertent rotation of the cap 602.

Referring now to FIG. 25A, in some embodiments, the interior lip 610 of the cap 602 can be a ramped surface that varies in distance or height from the aperture 608. FIG. 25A is a cross-sectional view showing one side of the cap 602. The opposite side of the cap can include a similar ramped surface 610 that is ramped in the opposite direction. Each surface 610 includes a non-ramped, flat section 610*a* and a ramped section 610*b*. In the assembled configuration, a first end portion 144*a* of the head portion 144 contacts a non-ramped section 610*a* of one of the surfaces 610 and a second end portion 144*b* of the head portion 144 contacts a non-ramped section 610*a* of the other surface 610 (see FIG. 22). The biasing force of the spring 134 urges the cap 602 outwardly to engage the adjacent surfaces of the head portion 144.

Figure 25C:
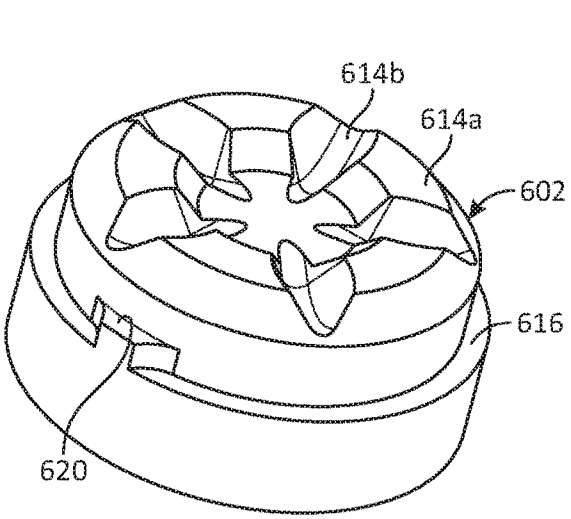
Figure 25B:
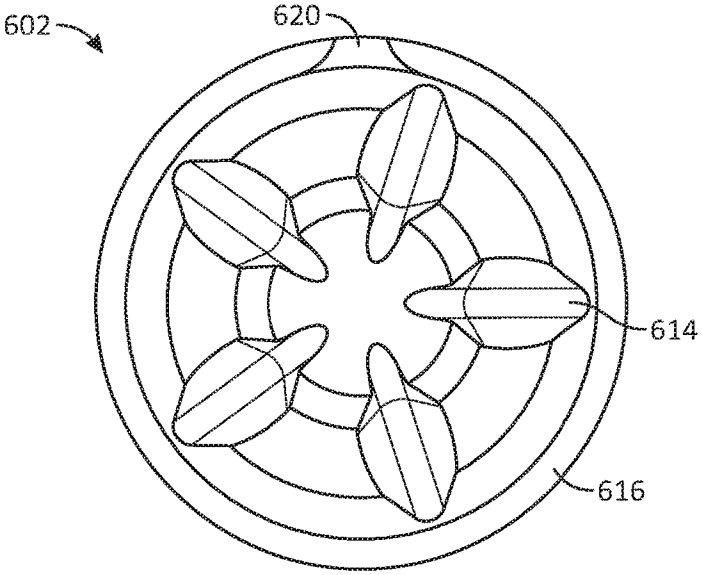
Figure 25E:
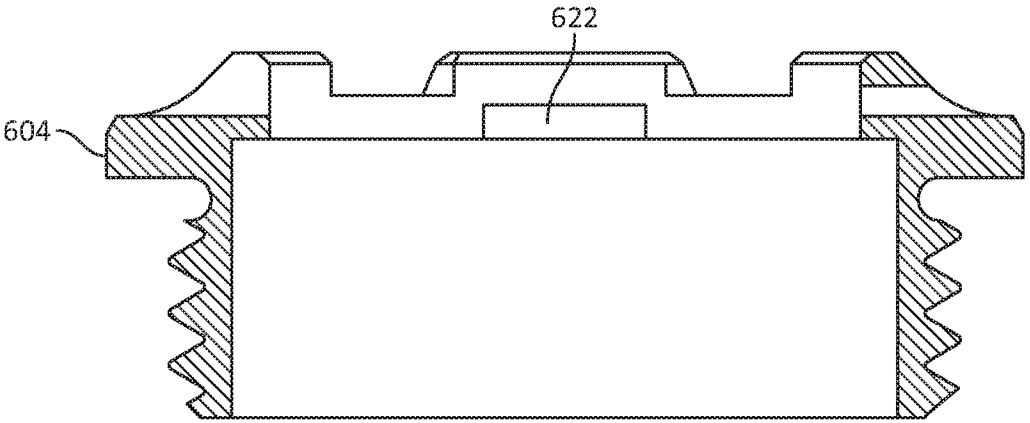
FIGS. 25D-25E show bottom plan and cross sectional views of the collar of the pivot mechanism of FIG. 18.
Figure 25D:
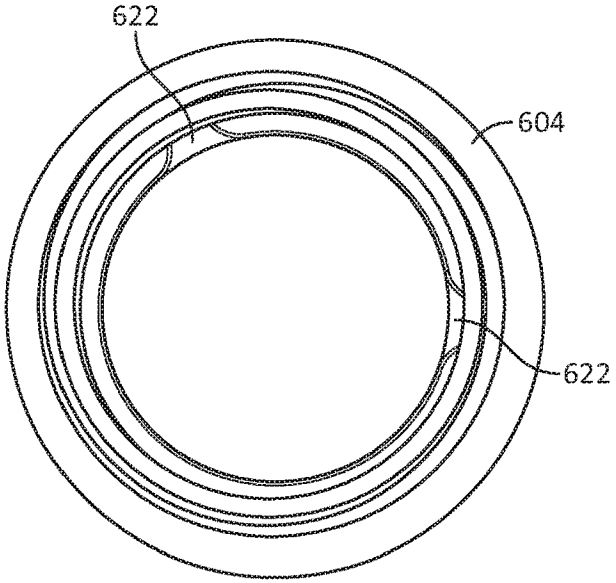
Figure 27:
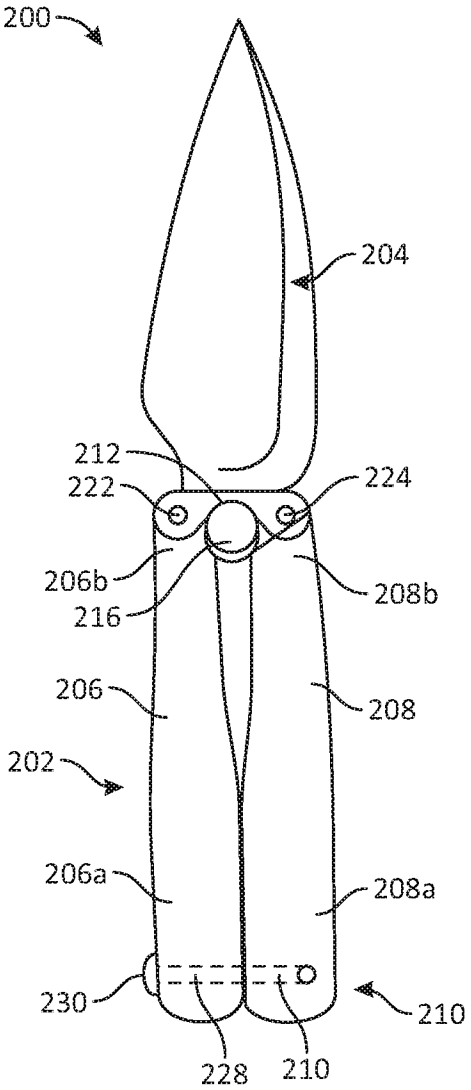
FIG. 27 shows an assembled top view of the folding knife of FIG. 26.

As shown in FIGS. 25B and 25C, the outer shoulder 616 can include at least one stop member 620. As shown in FIGS. 25D and 25E, an inner surface of the collar 604 one or more notches 622 (two in the illustrated embodiment) configured to receive a stop member 620. When the knife is in the assembled configuration, the stop member 620 is received within one of the notches 622. The biasing force of the spring 134 along with the engagement of the stop member within a notch 622 resists inadvertent rotation of the cap 602, thereby firmly retaining the forward ends of the handle portions together.

Depressing the cap 602 inwardly against the bias of the spring 134 moves surfaces 610 away from the head portion 144 and the stop member 620 out of the notch 622. Rotation of the cap 602 relative to the handle while the cap is in the depressed position rotates the cap 602 from the locked position where the head portion 144 is rotationally offset from the aperture 608 to the unlocked position where the head portion is rotationally aligned with the aperture 608. When the cap reaches the unlocked position and manual pressure on the cap is released, the stop member 620 can be urged into the other notch 622 under the force of the spring 134. As the cap 602 is rotated to the unlocked position, the first and second end portions 144*a*, 144*b* rotate over the ramped sections 610*b* to reduce frictionally contact with the head portion and facilitate rotationally movement of the cap. Likewise, during rotation of the cap from the unlocked position to the locked position when assembling the knife, there is initially less resistance to rotation of the cap due to positioning of the first and second end portions 144*a*, 144*b* of the head portion 144 over the ramped sections 610*b*. Resistance against rotation then increases as the first and second portions 144*a*, 144*b* are rotated over the non-ramped sections 610*a* and the cap reaches the locked position.

Desirably, although not necessarily, the cap 602 and collar 604 can be configured such that rotating the cap 602 one revolution or less relative to the collar 604 moves the cap 602 between the locked and unlocked positions. For example, in certain embodiments, the cap 602 can be rotated 10-180 degrees relative to the collar 604 to move the cap 602 between the unlocked and locked positions. In the illustrated embodiment, the cap is rotated 120 degrees between the locked and unlocked positions. As shown in FIG. 25D, the notches 622 is angularly spaced 120 degrees apart from each other so that the stop member 620 can engage one notch 622 in the locked position and the other notch 622 in the unlocked position.

The protrusion 612 can be integrally formed as a portion the cap 602 as shown (see FIG. 21). In other embodiments, the protrusion 612 can be releasably (e.g., by screw or other removable fastener) or permanently (e.g., by welding) coupled to the cap 602. The protrusion can comprise a textured pressing surface 614, which cane comprise, for example, a plurality of ridges 614*a* and notches 614*b* (see FIGS. 25B and 25C), to aid in a user's ability to find the protrusion in low visibility conditions, and to allow a user to more easily manipulate the protrusion.

The knife 100 having locking mechanism 600 can be assembled and/or disassembled in essentially the same manner as the previously described embodiment (FIGS. 11-20). To lock the knife 100 in the assembled configuration, a user can manually depress the cap 602 using protrusion 612, compressing the spring 134 and, while retaining the cap 602 in a depressed position, rotate the cap 602 relative to the head portion 144 of the pivot member 130, moving the cap 602 into the locked position and restraining the first side portion 110 against separation from the second side portion 112. Once the cap 602 is in the locked position, the user can release the protrusion 612, allowing it to return to the raised position. Rotation of the cap 602 can be accomplished by rotating the cap relative to the handle using the finger or thumb that is depressing the cap or by rotating the handle relative to the cap while the cap is held in the depressed position. When the cap 602 is in the locked position and in the raised position, the spring 134 exerts biasing force against the cap 602 causing the interior lip 610 of the cap to engage the head portion 144 of the pivot member, thus restraining the cap 602 against rotational motion and holding the knife 100 in the assembled configuration. The blade 104 can then be pivoted between an open and a closed position.

To disassemble the knife 100 having locking mechanism 600, a user can depress the cap 602 to compress the spring 134 and rotate the protrusion 612 relative to the handle (or rotate the handle relative to the cap) to pivot the cap 602 into the unlocked position. The components can then be removed from one another laterally.

Figure 26:
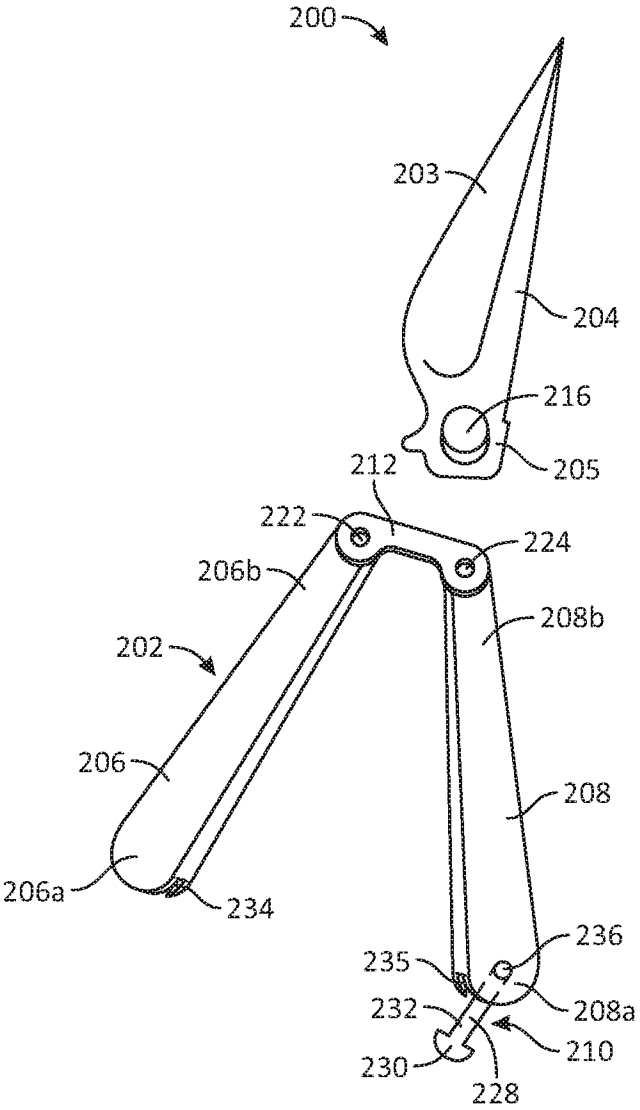
FIG. 26 shows an exploded view of another exemplary folding knife.

FIGS. 26-29 illustrate an exemplary embodiment of an easily disassembled folding knife 200. Referring to FIG. 26, the knife 200 can include a handle 202 and a blade 204 that are releasably coupled together.

Referring to FIG. 26, the handle 202 can include a first side portion 206 having a rear or proximal end portion 206*a* and a forward or distal end portion 206*b*, a second side portion 208 having a rear or proximal end portion 208*a* and a forward or distal end portion 208*b*. The handle 202 can also include a connector 212 configured for coupling the first side portion 206 to the second side portion 208 and a locking member 210 configured for securing the first and second side portions 206, 208 relative to each other.

The connector 212 can be pivotably coupled to distal end portions 206*b*, 208*b* of the first and second side portions 206, 208, by respective pins 222, 224. As such, the first and second side portions 206, 208 can be pivoted relative to the connector 212 between an open configuration (e.g., FIG. 26) and a closed configuration (e.g., FIG. 27).

The handle 202 can be retained in the secured position by the locking member 210. Various types of locking members can be used. For example, the locking member 210 comprises a pivot arm 228 having a head portion 230 with a first width and a neck portion 232 with a second width that is smaller than the first width. In some embodiments, the pivot arm can be "T"-shaped. The neck portion 232 of the pivot arm 228 can be pivotably coupled to and extend from the second side portion 208 of the handle 202 (e.g., by a pin 236). The first side portion 206 can comprise a slot 234 sized and/or configured for receiving the neck portion 232 of the pivot arm 228. The first side portion 206 of the handle 202 similarly can have a slot 235 that receives the neck portion 232. When the pivot arm 228 is in a locked position (e.g., FIG. 27), the neck portion 232 of the pivot arm 228 extends through the slots 234, 235 of the handle 202 and the head portion 230 engages an outer surface of the first side portion 206 of the handle 202, thereby preventing relative movement between the first and second side portions 206, 208 of the handle 202. In the unlocked position (e.g., FIG. 26), the pivot arm 228 is removed from the first side portion 206 of the handle 202, thereby allowing the first and second side portions 206, 208 of the handle 202 to move relative to each other about the pins 222, 224.

As can be appreciated, the handle 202 in the illustrated embodiment has a construction similar to the construction of a balisong or butterfly knife in the way the first and second side portions 206, 208 can be pivoted away and toward each other and retained in locked position. Any of various locking members used in balisong or butterfly knives can be implemented in the knife 200.

In some embodiments, the locking member 210 can comprise interlocking teeth that require multi-directional force from a user to disengage. For example, the locking mechanism can resemble the locking mechanism of a hemostat. In such embodiments, the first side portion can comprise a first set of teeth and the second side portion can comprise a second set of teeth configured to correspond with the first set. A user can lock the handle in the locked position by interlocking the first and second sets of teeth. The interlocked sets of teeth can retain the first and second side portions against lateral movement away from each other. To unlock the handle 202, the user can disengage the teeth and separate the first and second side portions 206, 208.

Figure 28:
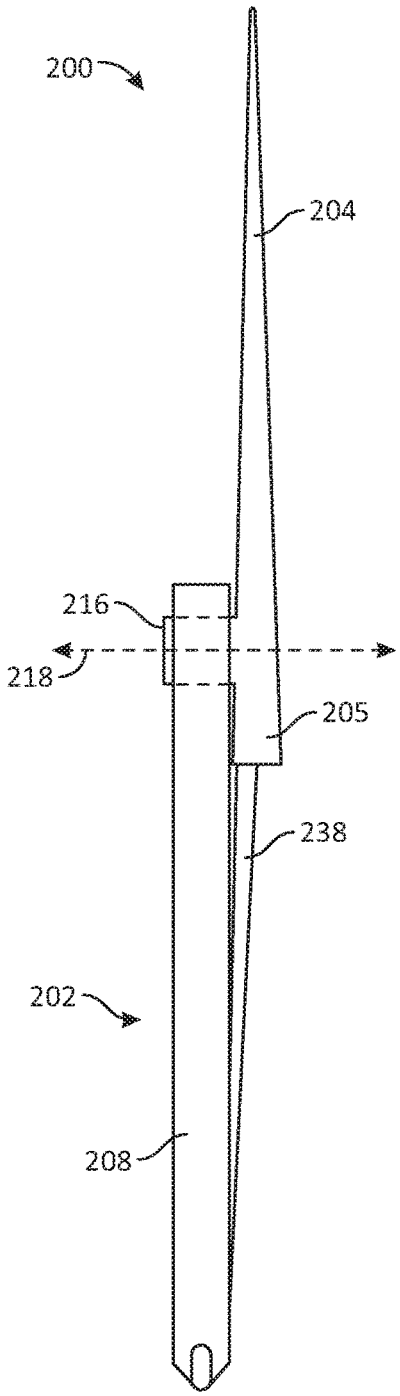
FIG. 28 shows a side view of the folding knife of FIG. 26.

The blade 204 can have a pivot member 216 coupled to and extending laterally from a side surface of a tang 205 of the blade 204. The blade 204 can pivot relative to the pivot member 216 about a pivot axis 218 (FIG. 28). This can be accomplished, for example, by coupling the blade 204 to the pivot member with a bearing assembly 219 (FIG. 29).

Figure 29A:
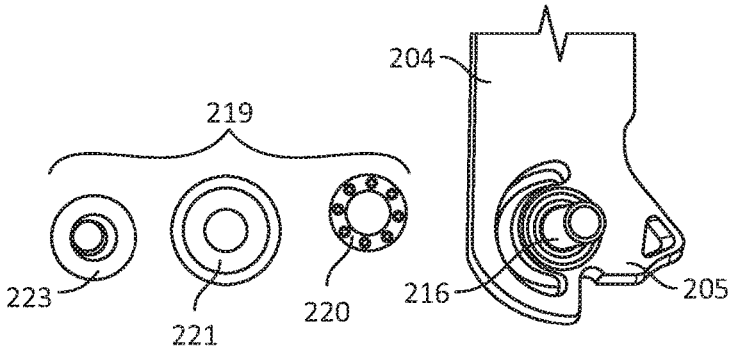
FIG. 29A shows an exploded view of the bearing assembly of the knife of FIG. 26.
Figure 29B:
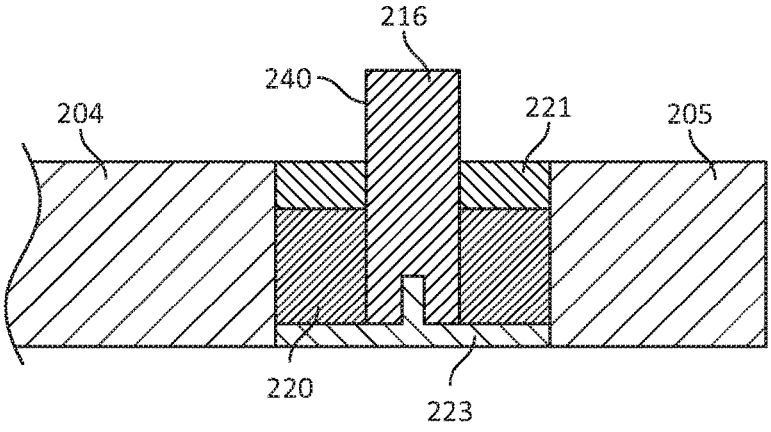
FIG. 29B is a cross sectional view of the blade and bearing assembly of FIG. 29A.

Referring to FIGS. 29A and 29B, the bearing assembly 219 can allow the blade 204 to pivot relative to the handle 202. The bearing assembly 219 can comprise a bearing race 220, a washer 221, and a screw 223. As shown in FIG. 29B, the bearing race 220 and the washer 221 can be disposed within an opening in blade 204. The pivot member 216 can extend through the bearing race 220 and the washer 221 and can be secured in place by the screw 223, which can be disposed in the opening of the blade opposite the washer 221. The threaded shaft of the screw 223 can be tightened into an internally threaded bore of the pivot member 216. The bearing race 220 includes a plurality of bearing balls or cylinders that contact the outer surface of the pivot member 216, allowing the pivot member 216 to rotate relative to the blade 204, and vice versa. The pivot member 216 has an end portion 240 that extends outwardly from the side of the blade. The handle 202 can be coupled to the end portion 240 of the pivot member 216, allowing the blade 204 to rotate relative to the handle 202.

The components thus described, assembly of the knife 200 will now be explained. With the handle in the open configuration (e.g., FIG. 26), the knife 200 can be assembled by inserting the end portion 240 of the pivot member 216 between the first and second side portions 206, 208 of the handle 202 at proximal end portions 206*a*, 208*a* of the first and second side portions 206, 208. The handle 202 can then be moved from the open configuration to the closed configuration (e.g., FIG. 27). As the first and second side portions 206, 208 of the handle 202 move toward each other, the first and second side portions 206, 208 engage and secure the pivot member 216 therebetween. In this manner, the pivot member 216 is clamped between the first and second side portions 206, 208 of the handle 202 with a frictional engagement. The first and second side portions 206, 208 of the handle 202 can be locked together by moving the locking member 210 from the unlocked configuration to the locked configuration, as described above.

The first and second side portions 206, 208 can be formed with grooves or ridges along their inner surfaces adjacent the connector 212. The grooves or ridges are positioned to grip the outer surface of the pivot member 216 when the handle is in the closed position to enhance the holding force of the first and second side portions 206, 208 holding the blade in place relative to the handle. In some embodiments, the handle can include an adjustment mechanism used in locking pliers or a vice grip that allows a user to adjust the gripping force of the first and side portions 206, 208 against the pivot member/bearing assembly.

In the assembled configuration, the blade 204 can be pivoted around the pivot member 216 relative to the handle 202 between an open position and a closed position. In some embodiments, the knife 200 can further comprise a blade protecting member, or shielding member (not shown) connected to, for example, one side of the second side portion 208 of the handle 202. The shielding member and/or the second side portion can define a blade receiving cavity configured to receive an edge 203 of the blade 204 when the blade 204 is in the closed position. In some embodiments, one or both of the first and second side portions 206, 208 can be configured to at least partially receive the sharpened edge of the blade when it is pivoted from the open position shown in FIG. 27 to a closed position, which may be 180 degrees from the open position.

Referring now to FIG. 28, in some embodiments, the knife 200 can further comprise a blade lock 238, such as a liner lock. The blade lock 238 can be coupled to, for example, the first side portion 206 and can be configured to retain the blade in the open position. The blade lock 238 can be biased into a position engaging an edge of the tang 205 of the blade 204 to retain the blade in the open position. When the knife 200 is in a fully assembled configuration, the blade lock 238 can protect against inadvertent closing of the blade 204 after it has been opened by a user.

The knife 200 can be easily disassembled by unlocking the locking member 210 and opening the handle 202.

Figure 31:
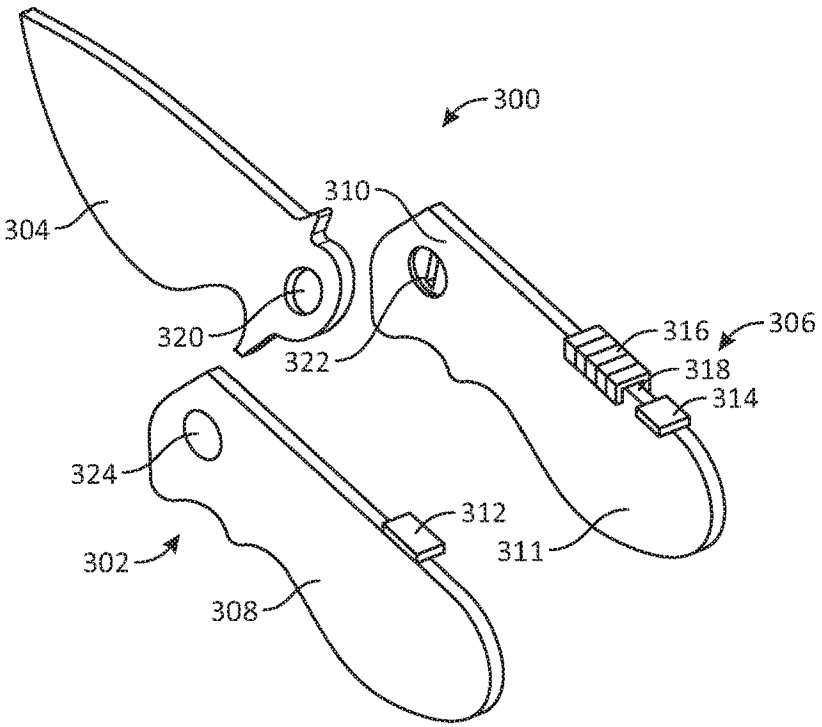
FIG. 31 shows an exploded perspective view of the folding knife of FIG. 30.
Figure 30:
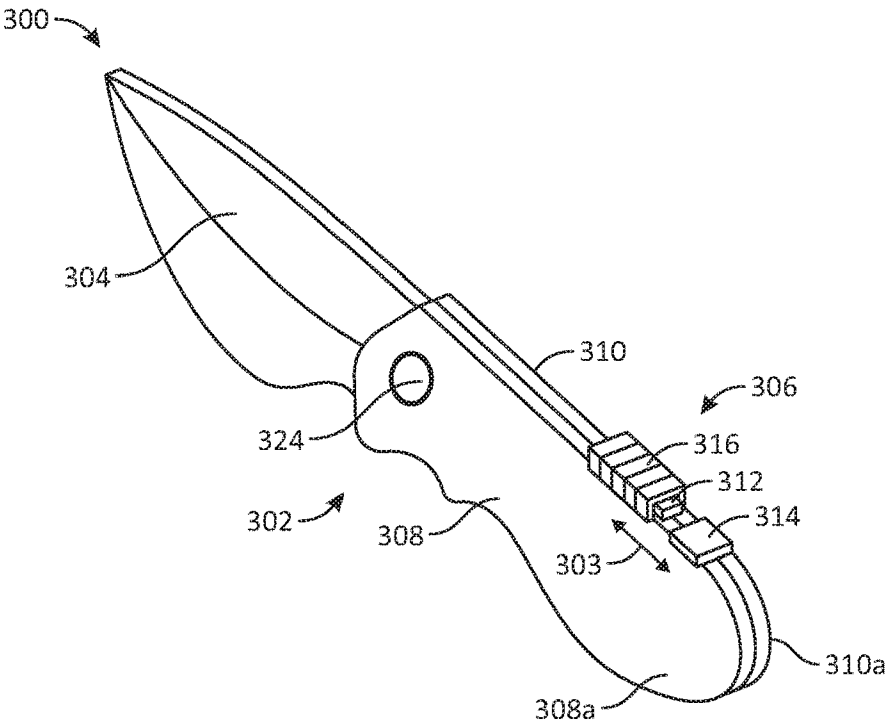
FIG. 30 shows a perspective view of an exemplary folding knife.

FIGS. 30-31 illustrate an alternative embodiment of an easily disassembled folding knife 300. Knife 300 can include a handle 302, a blade 304, and a locking mechanism 306 movable between a locked position, wherein the knife is retained in an assembled configuration and an unlocked position, wherein the knife can be disassembled. The blade can be pivotably connected to the handle such that the blade can pivot around an axis between an open position and a closed position. The handle 302 can include a first side portion 308 having a rear or proximal end portion 308*a* and a forward or distal end portion 308*b*, a second side portion 310 having a rear or proximal end portion 310*a* and a forward or distal end portion 310*b*. In some embodiments, the locking mechanism can be a retaining member configured to releasably couple a plurality of protrusions, and in other embodiments, the locking mechanism can be various other suitable means of retaining the first and second side portions against lateral movement away from one another, as described in more detail below.

Referring now to FIG. 31, the locking mechanism 306 can comprise a first protrusion 312 coupled to the proximal end portion 308*a* of the first side portion 308, a second protrusion 314 coupled to the proximal end portion 310*a* of the second side portion 310, and a retaining member 316 movable between a locked position and an unlocked position. The first and second protrusions 312, 314 can be configured such that when the knife 300 is in an assembled configuration, the first and second protrusions 312, 314 are disposed collinearly, allowing the retaining member 316 to cover and retain both protrusions when the retaining member is in the locked position.

The first and second protrusions 312, 314 can extend laterally from the first and second side portions 308, 310, respectively, such that when the handle 302 is in an assembled configuration the first and second protrusions 312, 314 are disposed adjacently and collinearly with one another. In some embodiments, the first and second protrusions 312, 314 can be integrally formed with the first and second side portions, respectively, with the first side portion 308 and the first protrusion 312 being formed from a single piece of material and the second side portion 310 and second protrusion 314 being formed from a single piece of material. Alternatively, the first and second protrusions 312, 314 can be releasably coupled to the first and second side portions 308, 310 (e.g., by screw, or other removable fastener) or the first and second protrusions can be permanently coupled to the first and second side portions (e.g., by welding).

Referring now to FIG. 30, the retaining member 316 can be slidably coupled to, for example, the second side portion 310 and can be slidable (e.g., in the directions indicated by arrow 303 in FIG. 30) between the locked and unlocked positions. In other embodiments, the restraining member 316 may be pivotably coupled to, for example, the second side portion 310 and can be pivoted between locked and unlocked positions.

The retaining member 316 can have a groove 318 (see FIG. 31) configured to fit over and retain first and second protrusions 312, 314 within the groove 318 when the retaining member 316 is in the locked position. The retaining member 316 and the first and second protrusions 312, 314 can be any of various corresponding shapes, such as, without limitation, square, rectangular, circular, flat-oval (e.g., a shape comprising an oval with flat sides), etc.

In use, the groove 318 of the retaining member 316 restrains the first and second protrusions 312, 314 from moving laterally relative to one another, thus preventing lateral separation of the first and second side portions 308, 310 of the handle while the retaining member 316 is in the locked position. Conversely, sliding the retaining member 316 relative to the first and second protrusions (e.g., distally) releases the first and second protrusions from the groove 318, thus allowing lateral separation of the first and second side portions 308, 310 of the handle, as shown in FIG. 28.

In some embodiments, the locking mechanism 306 can comprise a spring (not shown) or other biasing element configured to bias the retaining member 316 into the locked position. In such embodiments, to disassemble the knife 300, a user can actuate the retaining member 316 against the bias (e.g., distally) until the first and second protrusions 312, 314 are no longer retained within the groove 318. The first and second side portions 308, 310 can then be laterally separated. Once the first and second protrusions 312, 314 are no longer adjacent one another, the user can release the retaining member 316.

In other embodiments, the locking mechanism 306 can comprise various other biasing elements configured to help retaining the locking mechanism in the locked position. In some embodiments, the locking mechanism 306 can further comprise a detent element (not shown) configured to help retain the locking mechanism in the locked position. The detent element can be, for example, a ball extending from, for example, the first protrusion 312 that extends into a corresponding recess in the groove 318 of the retaining member 316. A spring or other biasing element can contact the ball and bias the ball into the recess, thereby helping retain the retaining member 316 in the locked position.

Referring again to FIG. 31, to assemble the knife 300, an opening 320 of the blade 304 can be disposed over a pivot member 324 extending from the first side portion 308. A pivot opening 322 extending into the second side portion 310 can then be aligned with the pivot member, and the second side portion can be laid over the first side portion such that the pivot member 324 is situated within the pivot opening 322 and such that the first and second protrusions 312, 314 are disposed collinearly with one another. The locking mechanism 306 can then be actuated into the locked position by, for example, sliding the groove 318 of the retaining member 316 over the first and second protrusions 312, 314, securing the first side portion 308 against the second side portion 310. That is, first side portion 308 is restrained against motion away from the second side portion 310 by the engagement of the groove 318 of the retaining member 316 with the first and second protrusions 312, 314.

To disassemble the folding knife 300, the locking mechanism 306 can be actuated (e.g., manually) until the first and second protrusions 312, 314 are no longer disposed within the retaining member 316. The remaining components of knife 300 can then be removed from one another laterally.

In some embodiments, the pivot opening 322 can have a non-circular shape and is adapted to receive a correspondingly shaped head portion of the pivot member (e.g., head portion 144 of pivot member 130). In such cases, the knife can be disassembled by first moving the retaining member 316 to the unlocked position and then rotating one of the first and second side portions 308, 310 relative to the other to rotationally align the head portion of the pivot member with the pivot opening 322. Once they are rotationally aligned, the second side portion 310 can be removed from the pivot member, followed by the blade 304. The knife can be assembled in the reverse manner.

Figure 32A:
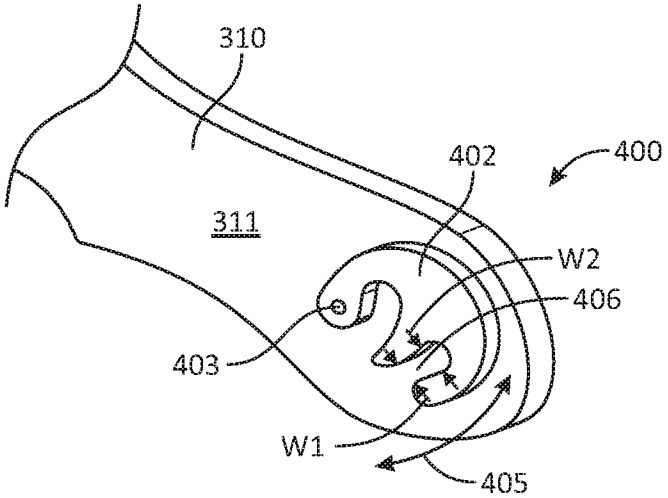
FIGS. 32A-32B show perspective views of an exemplary locking member shown with the folding knife of FIG. 30.
Figure 32B:
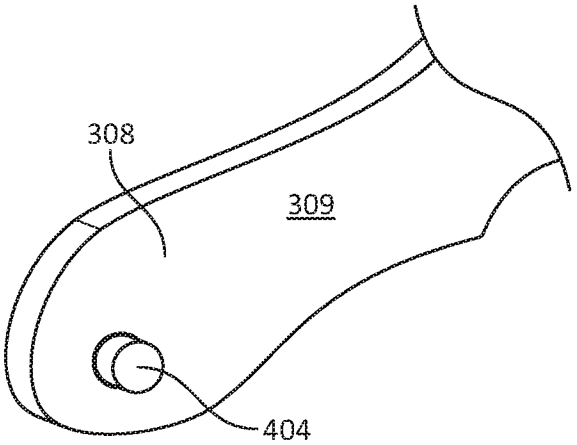
Figure 35:
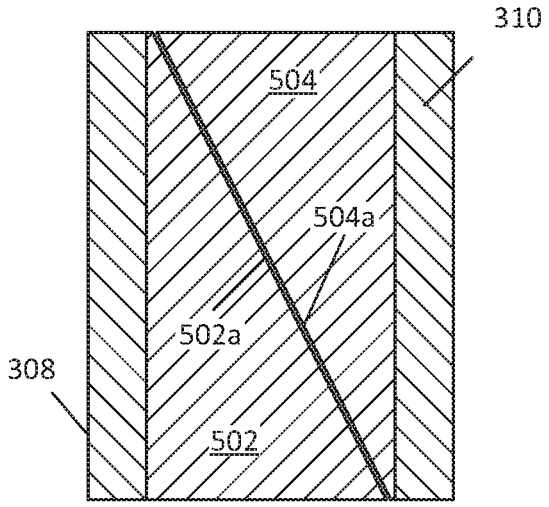
FIG. 35 shows a cross-sectional view of the locking member of FIG. 34 taken along line 35-35 shown in FIG. 31.
Figure 36:
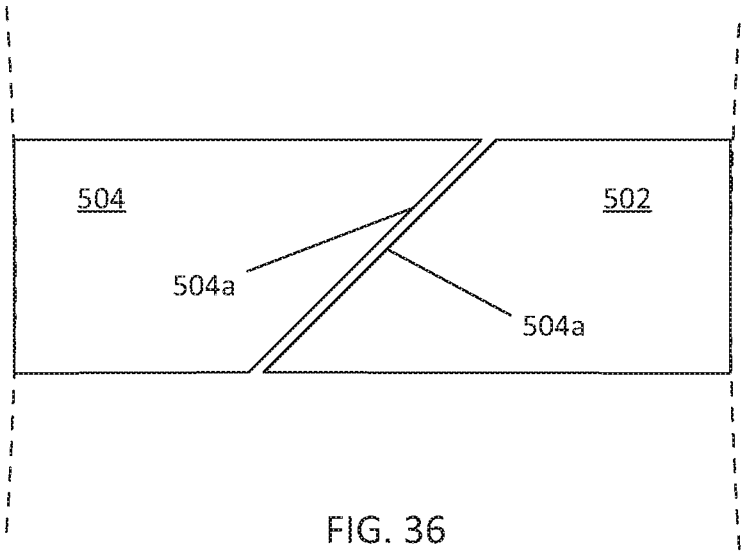
FIG. 36 shows a partial side view of the locking member of FIG. 33.

FIGS. 32A-32B illustrate an alternative embodiment of a locking mechanism 400 for a folding knife (e.g., folding knife 300). The locking mechanism 400 can comprise an engagement member 402 and a post 404 and can be actuatable between a locked position and an unlocked position, as described below. The other components of knife 300 are as described above.

As shown in FIG. 32A, the engagement member 402 can be pivotably coupled to, for example, an inner surface 311 of the second side portion 310 using a pin 403. The engagement member 402 can be pivotable in the directions indicated by arrow 405 between an unlocked position spaced from the post 404 and a locked position wherein the engagement member is releasably coupled to the post 404. The post 404 can extend, for example, from an inner surface 309 of the first side portion 308 as shown in FIG. 32B.

The engagement member 402 can have an opening 406 comprising a first portion having width W1 and a second portion having width W2. The width of the first portion W1 can be narrower than the width of the second portion W2. W1 can be sized slightly narrower than the diameter of post 404 and W2 can be substantially equal to or slightly larger than the diameter of post 404 such that when the engagement member 402 is releasably coupled to the post 404, the post 404 is retained within the second portion of the opening 406 and prevented from accidentally uncoupling, as described in more detail below.

It should be noted that, while FIGS. 32A-32B show the post 404 as substantially cylindrical and the second portion of the opening as correspondingly substantially circular, in any of the embodiments herein, the post can be any shape, including but not limited to square, hexagonal, triangular, ovular, etc. and the opening can be any shape correspondingly configured to retain the post within the second portion of the opening when the folding knife 300 is in the assembled configuration and the locking mechanism is in the locked position.

In some embodiments, the post 404 can have a head portion having a first width and a neck portion having a second width, wherein the first width is larger than the second width. In such embodiments, the width of the first portion of the opening W1 can be slightly narrower than the diameter of the neck portion of the post 404 and the width of the second portion of the opening W2 can be substantially equal to or slightly larger than the diameter of the neck portion of post 404 such that when the engagement member 402 is releasably coupled the post 404, the neck portion of the post 404 is retained within the second portion of the opening 406. In some embodiments, the inner surface 311 of the second side portion 310 can have a recess sized to fit the head portion of the post 404 such that when the knife 300 is in the assembled configuration, the head portion of the post 404 is disposed within the recess.

The folding knife 300 comprising locking mechanism 400 can be assembled in a manner similar to that described above with regard to a knife having the locking mechanism 306. The opening 320 of the blade 304 can be disposed over the pivot member 324 extending from the first side portion 308. The pivot opening 322 can then be aligned with pivot member, and the second side portion 310 can be laid over the first side portion such that the pivot mechanism is situated within the pivot opening 322. The locking mechanism 400 can then be actuated into the locked position by pivoting engagement member 402 relative to the second side portion 310 until the first portion of the opening abuts the post 404. To move the engagement member 402 into the locked position and thus retain the knife in the assembled configuration, a user can push the engagement member 402 against the post 404 such that the first portion of the opening 406 temporarily expands, allowing the post 404 to pass through the first portion of the opening 406 and into the second portion, locking the first side portion 308 to the second side portion 310. That is, first side portion 308 is restrained against motion away from the second side portion 310 by the engagement of the second portion of the opening 406 with the post 404. The narrower width of the first portion of the opening can help prevent the post from accidentally uncoupling from the opening.

To disassemble the folding knife 300, the locking mechanism 400 can be actuated (e.g., manually) into the unlocked position by pivoting the engagement member 402 away from the post 404 until the post 404 is no longer disposed within the opening 406. The remaining components of knife 300 can then be removed from one another laterally.

The locking mechanism 400 can be implemented in any of the folding knives described herein. For example, the knife 100 can include a locking mechanism 400 mounted at or near the rear ends of the first and second side portions 110, 112. The locking mechanism 400 can be used to secure the rear ends of the first and second side portions 110, 112 together in lieu of or in addition to the post 188. A locking mechanism 132 or 600 can be used to secure the forward ends of the first and second side portions 110, 112 as previously described.

FIGS. 33-36 illustrate an alternative embodiment of a locking mechanism 500 for folding knife (e.g., folding knife 300). The locking mechanism 500 can comprise first and second segments 502, 504. The locking mechanism can be actuatable between a locked position, wherein the first and second segments 502, 504 are releasably engaged with each other and an unlocked position wherein first and second segments 502, 504 are spaced apart from one another. The other components of knife 300 are as described above.

Figure 33:
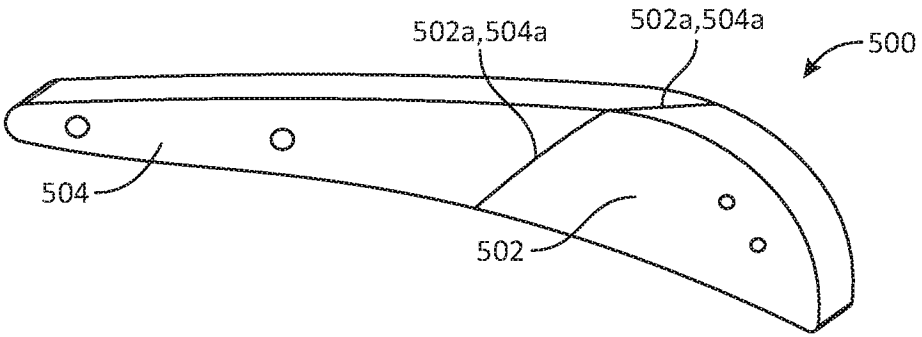
FIG. 33 shows a perspective view of an exemplary locking member.
Figure 34:
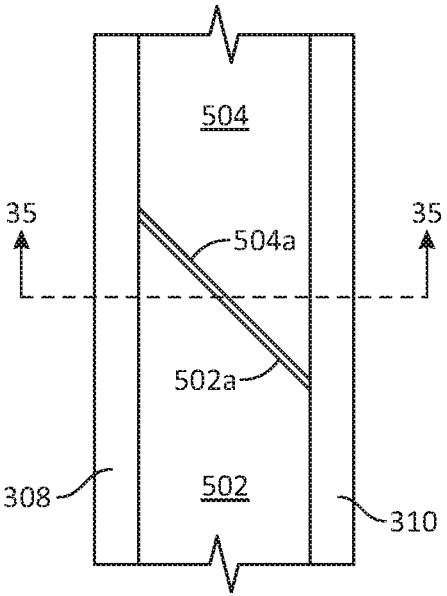
FIG. 34 shows a partial top view of the locking member of FIG. 33 shown with the folding knife of FIG. 30.

Referring to FIG. 33, the first segment 502 can be coupled to and extend laterally from, for example, an inner surface 309 (FIG. 34) of the first side portion 308. The second segment 504 can be coupled to and extend laterally from, for example, an inner surface 311 (FIG. 34) of the second side portion 310.

The first segment 502 can comprise first ramped and/or angled surface 502*a*, configured to releasably engage a corresponding ramped and/or angled second surface 504*a* of the second segment 504 when the knife 300 is in the assembled configuration and the locking mechanism 500 is in the locked position. When the locking mechanism 500 is in the locked position, the engagement of first and second surfaces 502*a*, 504*a* prevents vertical separation of the first and second side portions 308, 310 (see FIGS. 33 and 36) and lateral separation (see FIGS. 34-35) of the first and second side portions 308, 310. The ramped angle of the first and second surfaces 502*a*, 504*a* can prevent vertical and shear movement of the first and second side portions 308, 310 relative to one another. In some embodiments, the first and second angled surfaces can comprise a plurality of angled or ramped portions configured to interlock and prevent vertical and shear movement of the first and second side portions relative to one another.

For example, the second segment 504 can be actuatable (e.g., by sliding) between an unlocked position, wherein the first and second angled surfaces 502*a*, 504*a* are spaced apart, and a locked position, wherein the first and second angled surfaces 502*a*, 504*a* are releasably engaged (see FIG. 33). In other embodiments, the first segment 502 may be actuatable to move the locking mechanism 500 between the locked and unlocked positions.

In some embodiments, the locking mechanism 500 can comprise a spring (not shown) or other biasing element configured to bias, for example, the second segment 504 into the locked position. In such embodiments, to disassemble the knife, a user can actuate (e.g., manually) the second segment 504 by sliding or pushing it against the bias (e.g., distally toward the forward end of the handle) until the second surface 504*a* and the first surface 502*a* are no longer engaged, the first and second side portions 308, 310 can then be laterally separated. Once the first and second side portions 308, 310 are no longer laterally adjacent one another, the user can release the second segment 504.

In other embodiments, the locking mechanism can comprise various other biasing elements configured to help retaining the locking mechanism in the locked position. For example, the locking mechanism 500 can comprise a detent element (not shown) configured to help retain the second segment 504 in the locked position. The detent element can be, for example, a ball extending from, for example, the second surface 504*a* that extends into a corresponding recess in first surface 502*a*. A spring or other biasing element can contact the ball and bias the ball into the recess, thus helping retain the second segment 504 in the locked position.

The folding knife 300 comprising locking mechanism 500 be assembled in a manner similar to that described above. The opening 320 of the blade 304 can be disposed over the pivot member 324 extending from the first side portion 308. The pivot opening 322 can then be aligned with the pivot member, and the second side portion can be laid over the first side portion such that the pivot member is situated within the pivot opening 322. The locking mechanism 500 can then be actuated into the locked position by actuating (e.g., sliding) the second segment 504 relative to the second side portion 310 until the first and second surfaces 502*a*, 504*a* of the first and second segments 502, 504 releasably engage, locking the first side portion 308 to the second side portion 310. That is, first side portion 308 is restrained against motion away from the second side portion 310 by the engagement of the first surface 502*a* and the second surface 504*a*.

To disassemble the folding knife 300, the locking mechanism 500 can be actuated (e.g., manually) into the unlocked position, for example, by sliding the second segment 504 until the second surface 504*a* no longer engages the first surface 502*a*. The remaining components of knife 300 can then be removed from one another laterally.

The locking mechanism 500 can be implemented in any of the folding knives described herein. For example, the knife 100 can include a locking mechanism 500 mounted at or near the rear ends of the first and second side portions 110, 112. The locking mechanism 500 can be used to secure the rear ends of the first and second side portions 110, 112 together in lieu of or in addition to the post 188. A locking mechanism 132 or 600 can be used to secure the forward ends of the first and second side portions 110, 112 as previously described.

Figure 37:
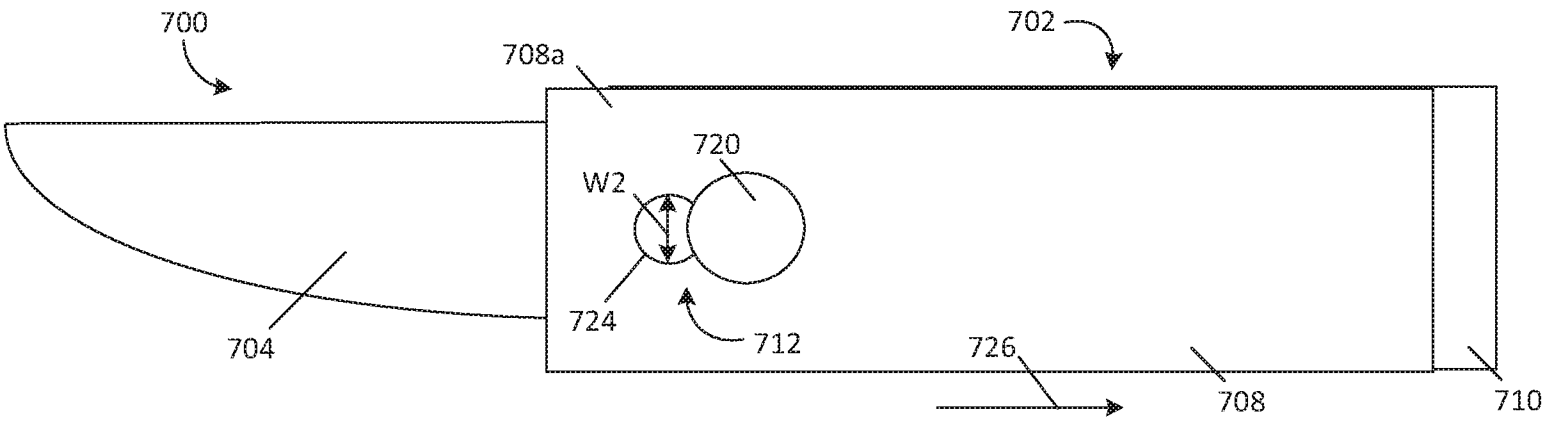
FIGS. 37-38 show side views of another exemplary folding knife.
Figure 38:
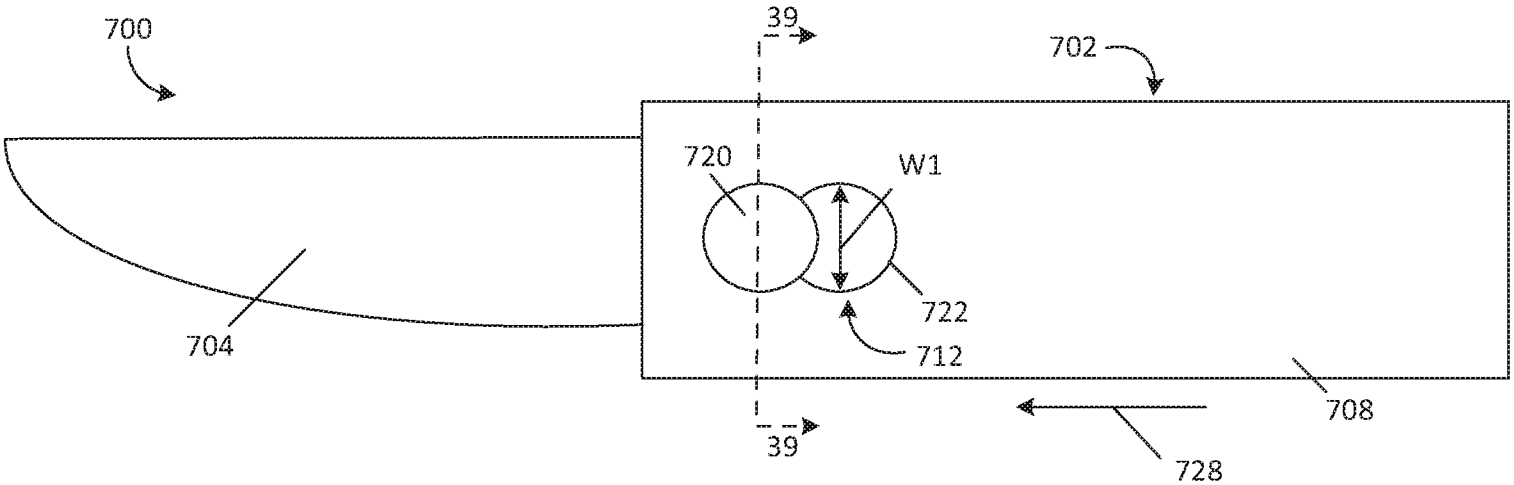
Figure 39:
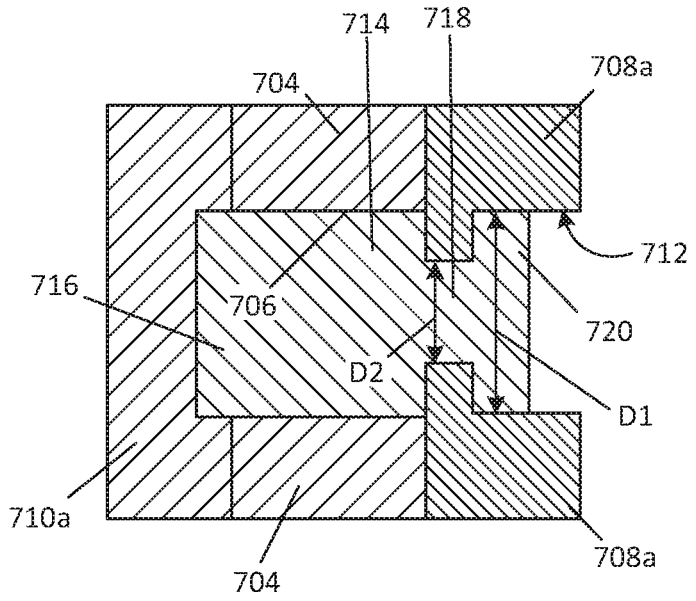
FIG. 39 shows a cross-sectional view of the knife of FIGS. 37-38 taken along line 39-39 shown in FIG. 38.

FIGS. 37-39 illustrate an exemplary embodiment of an easily disassembled folding knife 700. Referring to FIG. 37, the knife 700 can include a handle 702 and a blade 704 that are releasably coupled together. The blade 704 can have a pivot opening 706 (FIG. 39) extending through a tang portion of the blade.

The handle 702 can include a first side portion 708 and a second side portion 710. The first side portion 708 can have an opening 712 (shown partially obscured in FIGS. 37-38) in the front or distal end portion 708*a*. The second side portion 710 can have a pivot member 714 (FIG. 39) extending from an inner surface of a front or distal end portion 710*a* (FIG. 39). The pivot member 714 can be configured to engage the opening 712 to restrain the first and second side portions 708, 710 from lateral movement away from one another, as further described below.

Referring now to FIG. 39, the pivot member 714 can include a relatively wide base portion 716, a relatively narrow neck portion 718, and a relatively wide head portion 720. The pivot opening 706 of the blade 704 can be sized to fit over the head portion 720 and base portion 716 of the pivot member.

Figure 40:
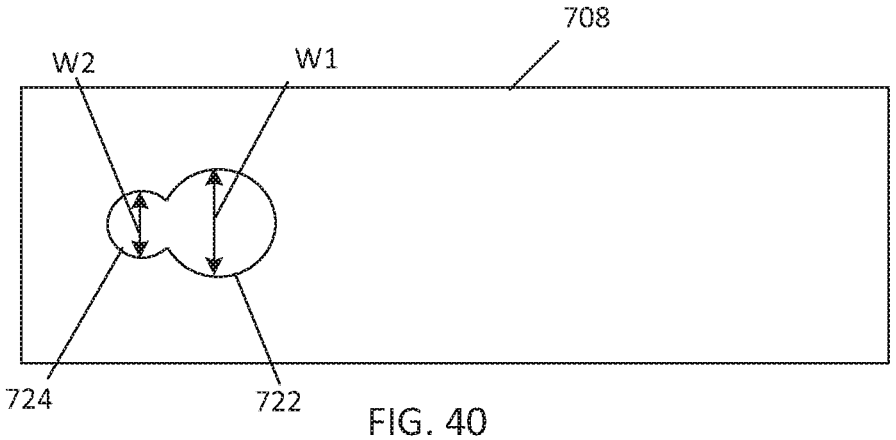
FIG. 40 is a side view of one of the side handle portions of the knife of FIG. 37.

As best shown in FIG. 40, the opening 712 can comprise a first portion 722 having width $W_1$ interconnected with a second portion 724 having width $W_2$. $W_1$ can be greater than $W_2$. Referring again to FIG. 39, the head portion 720 of the pivot member 714 can have a diameter $D_1$ and the neck portion 718 can have a diameter $D_2$. $D_1$ can be greater than $D_2$. The width $W_1$ of the first portion 722 of the opening 712 can be sized to allow the head portion 720 to pass through the first portion 722. The width $W_2$ of the second portion 724 can be sized such that the head portion 720 cannot pass through the second portion 724 and such that the neck portion 718 can be disposed within the second portion 724.

The second portion 724 can have a mouth (not shown) located at the junction between the first and second portions 722, 724 of the opening 712. The mouth can be sized to be slightly narrower than the diameter $D_2$ of the neck portion 718 such that the mouth must deform or expand slightly to allow the neck portion 718 to pass through it. The mouth helps retain the neck portion 718 within the second portion 724, helping maintain the knife 700 in its assembled state.

While the illustrated embodiment includes a substantially circular-shaped head portion 720, a substantially cylindrical neck portion 718, and corresponding substantially circular first and second portions 722, 724 of the opening 712, the head portion 720, neck portion 718, and corresponding first and second portions 722, 724 of the opening 712 can be any of various shapes, such as, without limitation, elliptical, square, triangular, cruciform (cross-shaped), flat-oval shaped (e.g., a shape comprising an oval with flat sides), rectangular, etc. While the illustrated embodiment shows the second portion 724 of the opening as being located distal to the first portion 722 of the opening, the openings can be positioned in any orientation.

In certain embodiments, the shape of the first and second portions 722, 724 of the opening 712 need not correspond exactly to the cross-sectional shape of the head portion 720 and the neck portion 718. For example, the first portion 722 can have any shape sized such that the head portion 720 can pass through the first portion 722, and the second portion 724 can have any shape sized such that the neck portion 718 can sit within the second portion 724 of the opening 712.

With the various components thus described, assembly and disassembly of the knife 700 will now be explained. To assemble the knife 700, the second side portion 710 (including the pivot member 714) can be laid on a flat surface with the pivot member 714 protruding outwardly from the second side portion. The blade 704 can then be laid over the second side portion 710 such that the pivot member 714 extends through the pivot opening 706. The first side portion 708 can then be laid down over the blade 704 such that the head portion 720 of the pivot member 714 extends through the first portion 722 of the opening 712.

The first side portion can then be translated (e.g., proximally in the orientation shown in FIG. 37) as indicated by arrow 726 until the first side portion 708 is aligned side-by-side with the second side portion 710 and the neck portion 718 is disposed within the second portion 724 of the opening 712 as shown in FIG. 38. To move the neck portion 718 into the second portion 724 of the opening 712 thus retain the knife in the assembled configuration, a user can push the neck portion 718 against the mouth (not shown) of the second portion 724 such that the mouth of the second portion 724 temporarily expands, allowing the neck portion 718 to pass from the first portion 722 of the opening 712 into the second portion 724, thus locking the first side portion 708 to the second side portion 710. In this position, the neck portion 718 is positioned within the second portion 724 of the opening 712. Thus, the first side portion 708 is restrained against separation from the second side portion 710 as the head portion 720 of the pivot member engages the first side portion 708. The blade 704 can then be pivoted between the open and closed positions.

To disassemble the knife 700, a user can translate (e.g., by pushing) the first side portion such that the neck portion 718 of the pivot member 714 moves from the second portion 724 to the first portion 722 of the opening 712 (e.g., distally in the direction of arrow 728 in FIG. 38). Once the pivot member 714 is disposed within the second portion 724 the various components of the knife can then be removed from each other laterally.

In any of the embodiments described herein, any of various mechanisms can be used to lock the blade of a folding knife in the open and the closed positions, and a thumbstud can be used to stop the rotation of the blade when received in the handle.

Except where structurally impossible, any of the features described herein can be used in combination with any other feature described herein. For example, the features of the knife 100 can be combined with the features of the knife 200 or the knife 300 and vice-versa. In another embodiment, a folding knife can comprise the pivot mechanism of the knife 100 or the knife 700 and can include one or more of the locking mechanisms 306, 400, and 500. In another embodiment, a folding knife can comprise the handle portion of folding knife 200 and can include one or more of the locking mechanisms 306, 400, and 500.

Further, in any of the embodiments described herein, a ball bearing system such as is described in U.S. Pat. App. Pub. No. 2012/0234142 can be incorporated into the knife in order to reduce friction forces exerted against the blade of the knife, for example, as the blade is opened or as the blade is closed. In any of the embodiments described herein, a knife can be provided in a kit with a plurality of blades or other tools. Because the folding knives described herein are more readily disassembled and re-assembled than other known knives, any of the blades in the kit can easily be installed in the knife, depending on the particular functionality desired. In any of the embodiments described herein, a knife can be provided with a clip secured to the handle portion so that the knife can be clipped onto, for example, a user's belt or pocket.

The embodiments disclosed herein provide advantages over prior folding knives, including prior folding knives having removable blades. For example, some of the knives disclosed herein have a simple construction which can increase reliability of the knife and simplify the process of removing or replacing the blade. In the illustrated embodiments, the handle can be disassembled and the blade can be removed or replaced by hand, without using any tools, and preferably without removing any small parts, thereby reducing or eliminating the chance of losing a part of the knife.

In view of the many possible embodiments to which the principles of the disclosed technology may be applied, it should be recognized that the illustrated embodiments are only examples and should not be taken as limiting the scope of the claims. Rather, the scope of the claimed subject matter is defined by the following claims and their equivalents.

The invention claimed is:

1. A folding knife, comprising:

a handle comprising a first side portion and a second side portion laterally spaced relative to each other and defining a blade-receiving cavity therebetween, wherein the first side portion has a first opening at a distal end portion thereof, and wherein the second side portion has a second opening at a distal end portion thereof;

a blade disposed between the first side portion and the second side portion, wherein the blade has a pivot opening in a tang portion of the blade; and a pivot mechanism comprising a pivot member and a locking mechanism, wherein the pivot member extends from the second side portion, through the pivot opening of the blade, and into the first opening of the first side portion such that the blade is pivotable relative to the handle about the pivot member between an open position and a closed position, wherein the locking mechanism has a cap extending into the first opening of the first side portion and comprising an inner surface configured to selectively engage the pivot member, wherein the cap is rotatable relative to the first side portion and the pivot member between a locked position and an unlocked position, wherein when the cap is in the locked position the inner surface of the cap engages the pivot member, preventing lateral separation of the first side portion and the second side portion, and wherein when the cap is in the unlocked position the cap disengages the pivot member, allowing lateral separation of the first side portion and the second side portion.

2. The folding knife of claim 1, wherein the locking mechanism comprises an actuator, and wherein the actuator can be actuated by a user to move the cap between the locked position and the unlocked position.

3. The folding knife of claim 2, wherein the actuator is a lever.

4. The folding knife of claim 3, wherein the lever is pivotably coupled to the cap.

5. The folding knife of claim 4, wherein the lever is pivotable relative to the cap and the first side portion between a stored position and a use position, wherein in the stored position, the lever is substantially parallel to an outer surface of the first side portion, and wherein in the use position, the lever is substantially perpendicular to the outer surface of the first side portion.

6. The folding knife of claim 5, further comprising a spring coupled to the lever, wherein the spring is configured to exert a biasing force on the lever to retain the lever in the stored position or the use position.

7. The folding knife of claim 5, wherein the locking mechanism further comprises a collar configured to retain the cap within the first opening of the first side portion, wherein the collar comprises a recess configured to receive the lever in the stored position and to prevent the lever from rotating relative to the first side portion when the lever is in the stored position.

8. The folding knife of claim 1, wherein the locking mechanism further comprises a collar configured to retain the cap within the first opening of the first side portion.

9. The folding knife of claim 8, wherein the pivot mechanism further comprises a spring disposed between the cap and the blade, wherein the spring is configured to bias the cap toward the collar.

10. The folding knife of claim 1, wherein the cap comprises a button, and wherein the button can be moved laterally and rotationally relative to the first side portion to move the cap between the locked position and the unlocked position.

11. The folding knife of claim 10, wherein the locking mechanism further comprises a collar coupled to the first side portion.

12. The folding knife of claim 11, wherein the pivot mechanism further comprises a spring disposed between the button and the blade, wherein the spring is configured to exert a lateral force against the button to bias the button toward the collar.

13. The folding knife of claim 1, wherein the cap is configured to rotate less than one revolution relative to the first side portion and the pivot member between the unlocked position and the locked position.

14. The folding knife of claim 1, wherein the cap is configured to rotate between 10-180 degrees relative to the first side portion and the pivot member between the unlocked position and the locked position.

15. The folding knife of claim 1, wherein the cap is configured to rotate about 120 degrees relative to the first side portion and the pivot member between the unlocked position and the locked position.

16. A folding knife, comprising:

a handle comprising a first side portion and second side portion, wherein the first side portion has a first opening;

a blade disposed between the first and second side portions; and a pivot mechanism comprising a pivot member and a locking mechanism, wherein the pivot member comprises a main body portion, a non-circular head portion, and a neck portion disposed between the main body portion and the non-circular head portion, wherein the main body portion extends from the second side portion and through the blade, wherein the non-circular head portion extends into the first opening of the first side portion, wherein the locking mechanism comprises a cap extending into the first opening of the first side portion and configured to selectively engage head portion of the pivot member, wherein the cap is rotatable relative to the non-circular head portion of the pivot member between a locked position and an unlocked position, wherein when the cap is in the locked position the cap engages the non-circular head portion of the pivot member, preventing lateral separation of the first side portion and the second side portion and retaining the blade therebetween, and wherein when the cap is in the unlocked position the cap disengages the non-circular head portion of the pivot member, allowing lateral separation of the first side portion, the second side portion, and the blade.

17. The folding knife of claim 16, wherein the cap comprises a non-circular opening, wherein the non-circular opening is configured for receiving the non-circular head portion of the pivot member, wherein the non-circular opening of the cap is rotationally offset relative to the non-circular head portion of the pivot member when the cap is in the locked position, and wherein the non-circular opening of the cap is rotationally aligned with the non-circular head portion of the pivot member when the cap is in the unlocked position.

18. The folding knife of claim 16, wherein the cap comprises an interior chamber with a radially-extending lip, wherein the radially-extending lip of the cap engages the non-circular head portion of the pivot member when the cap is in the locked position, and wherein the radially-extending lip of the cap disengages the non-circular head portion of the pivot member when the cap is in the unlocked position.

19. The folding knife of claim 16, wherein the locking mechanism further comprises a collar coupled to the first side portion, and wherein the cap comprises an outer shoulder configured to engage the collar as the cap rotates between the locked position and the unlocked position.

20. The folding knife of claim 19, wherein the outer shoulder of the cap comprises a ramped portion.

* * * * *